US012687027B2

(12) United States Patent
Zaranok

(10) Patent No.: US 12,687,027 B2
(45) Date of Patent: Jul. 21, 2026

(54) TILE INSTALLATION SYSTEMS AND METHODS OF USING SAME

(71) Applicant: Builders Adventure, Inc., Buffalo Grove, IL (US)

(72) Inventor: Vladimir Zaranok, Buffalo Grove, IL (US)

(73) Assignee: Builders Adventure, Inc., Buffalo Grove, IL (US)

( * ) Notice: Subject to any disclaimer, the term of this patent is extended or adjusted under 35 U.S.C. 154(b) by 552 days.

(21) Appl. No.: 18/163,965

(22) Filed: Feb. 3, 2023

(65) Prior Publication Data

US 2023/0243165 A1 Aug. 3, 2023

Related U.S. Application Data

(60) Provisional application No. 63/306,497, filed on Feb. 3, 2022.

(51) Int. Cl.
*E04F 21/18* (2006.01)
*E04F 21/00* (2006.01)

(52) U.S. Cl.
CPC ..... *E04F 21/1877* (2013.01); *E04F 21/0092* (2013.01)

(58) Field of Classification Search
CPC ... E04F 21/0092; E04F 21/1877; E04F 21/18; E04F 21/1838; E04F 13/0892; E04F 13/0862; E04F 2201/05; E04B 1/41; E04B 1/4107; E04B 1/4128; E04B 1/4135; E04B 1/4157; E04B 1/4164; E04B 1/4178; E04B 1/61; E04B 2001/6195; E04B 2001/386
See application file for complete search history.

(56) References Cited

U.S. PATENT DOCUMENTS

| | | | | |
|---|---|---|---|---|
| 4,223,505 | A * | 9/1980 | Krebel | E04F 13/0823 52/489.2 |
| 5,440,854 | A * | 8/1995 | Hohmann | E04B 1/4178 52/489.1 |
| 6,990,777 | B2 | 1/2006 | Poliacek et al. | |
| 7,070,667 | B1 | 7/2006 | Kirby | |
| 8,359,799 | B2 * | 1/2013 | Shapiro | E04D 12/006 52/351 |
| 8,429,866 | B2 * | 4/2013 | Knight | E04B 2/58 52/506.03 |
| 8,898,978 | B2 | 12/2014 | Murray et al. | |
| 9,745,739 | B2 * | 8/2017 | Riepe | E04B 1/4178 |
| 10,011,997 | B1 * | 7/2018 | Bilge | E04F 13/0801 |
| 10,604,948 | B2 | 3/2020 | Tisdall et al. | |
| 2019/0093372 | A1 * | 3/2019 | Russo | E04F 21/20 |

FOREIGN PATENT DOCUMENTS

| | | | | |
|---|---|---|---|---|
| EP | 0287391 | A2 | 10/1988 | |
| GB | 2581209 | A * | 8/2020 | E01C 5/006 |
| JP | 11-107490 | A | 4/1999 | |
| JP | 2005-113386 | A | 4/2005 | |
| JP | 2005-171595 | A | 6/2005 | |
| JP | 2006-045911 | A | 2/2006 | |

* cited by examiner

*Primary Examiner* — Jessica L Laux
(74) *Attorney, Agent, or Firm* — Randy R. Micheletti; Incubate IP

(57) ABSTRACT

The present application provides systems for installing tile on a flat surface, such as a wall, and methods of using same to install tile.

20 Claims, 30 Drawing Sheets

TILE INSTALLATION SYSTEMS AND METHODS OF USING SAME

PRIORITY CLAIM

This application claims priority to U.S. Provisional Patent Application Ser. No. 63/306,497, filed Feb. 3, 2022, the entire contents of which is incorporated herein by reference and relied upon.

FIELD

The present disclosure provides systems for installing tile on a flat surface, such as a wall, and methods of using same to install tile.

BACKGROUND

Installing tile onto surfaces, especially non-horizontal (e.g., vertical) surfaces can be time consuming, inconvenient, and involve a high rate of material loss (e.g., due to breakage). In addition, many non-horizontal surfaces are not perfectly flat, rendering installation of flat tile products difficult. A need persists for systems that improve installation of tile on non-horizontal surfaces.

SUMMARY

In some embodiments, the present disclosure provides systems for installing tile, the systems comprising: a first support rail (100) configured to support a first end of a tile; a second support rail (100) configured to support a second, opposite end of the tile; optionally a third support rail (200) configured to support a midportion of the tile; a corner mounting anchor (400) configured to separate the tile from a second tile or from an adjacent surface by a predetermined distance; a corner anchor lock (500+700) configured to mate (e.g., releasably mate) with the end mounting anchor and compress the tile towards the first, second, or optional third support rail; at least one edge mounting anchor (600 or 800) configured to separate the tile from a second tile or from an adjacent surface by a second predetermined distance; and an edge anchor lock (700 or 900) configured to compress the first or second end of the tile towards the first, second, or optional support rail.

In other embodiments, the present disclosure provides kits comprising: at least two end support rails (100) each configured to support one end of a tile; a plurality of support rail mounts (300) each configured to be secured to a surface and each configured to be adjustably secured to an end support rail; a plurality of mounting anchors (400 or 500 or 700) each configured to temporarily secure an edge of a tile to an end support rail; and a plurality of mounting anchor locks (700 or 900) each configured to releasably mate with a mounting anchor and, when mated, to exert a compression force between an edge of the tile and an end support rail.

In still other embodiments, the present disclosure provides methods of installing tile on a surface, such as a substantially vertical surface, the method comprising: securing a first support rail to the surface; securing a second support rail to the surface at a predetermined distance from and substantially parallel to the first support rail; inserting an edge anchor (600 or 800) in a surface channel (116 or 216) of the first and/or second support rail; adhering the tile to surfaces of the first and second support rail and in contact with the edge anchor (e.g., using an adhesive disposed between the tile and the first and/or second support rail); temporarily applying a compression force between the tile and the first and/or second support rail by securing an edge anchor lock (700 or 900) to the edge anchor; removing, after adherence of the tile is substantially complete, the edge anchor lock (700 or 900) from the edge anchor (600 or 800); and removing a distal portion (620+630 or 830) from the edge anchor (600 or 800).

These and other embodiments are described in further detail herein below.

DETAILED DESCRIPTION

The present disclosure provides systems for installing tile on a flat surface, such as a wall, and methods of using same to install tile.

Referring now generally to FIGS. 1-30, systems of the present disclosure generally include at least two support rails 100/200 onto which the tile T is mounted. The support rails 100/200 are secured to the surface (e.g., a wall W1/W2) and optionally leveled/plumbed independently of the surface to provide a framework on which to mount the tile T. Such systems offer convenience to the installer, can provide a plumb or level foundation for tiling an untrue and/or uneven surface, and can provide a more secure adherence of the tile T to the surface compared to traditional methods and systems.

Support Rails

Figure 12:
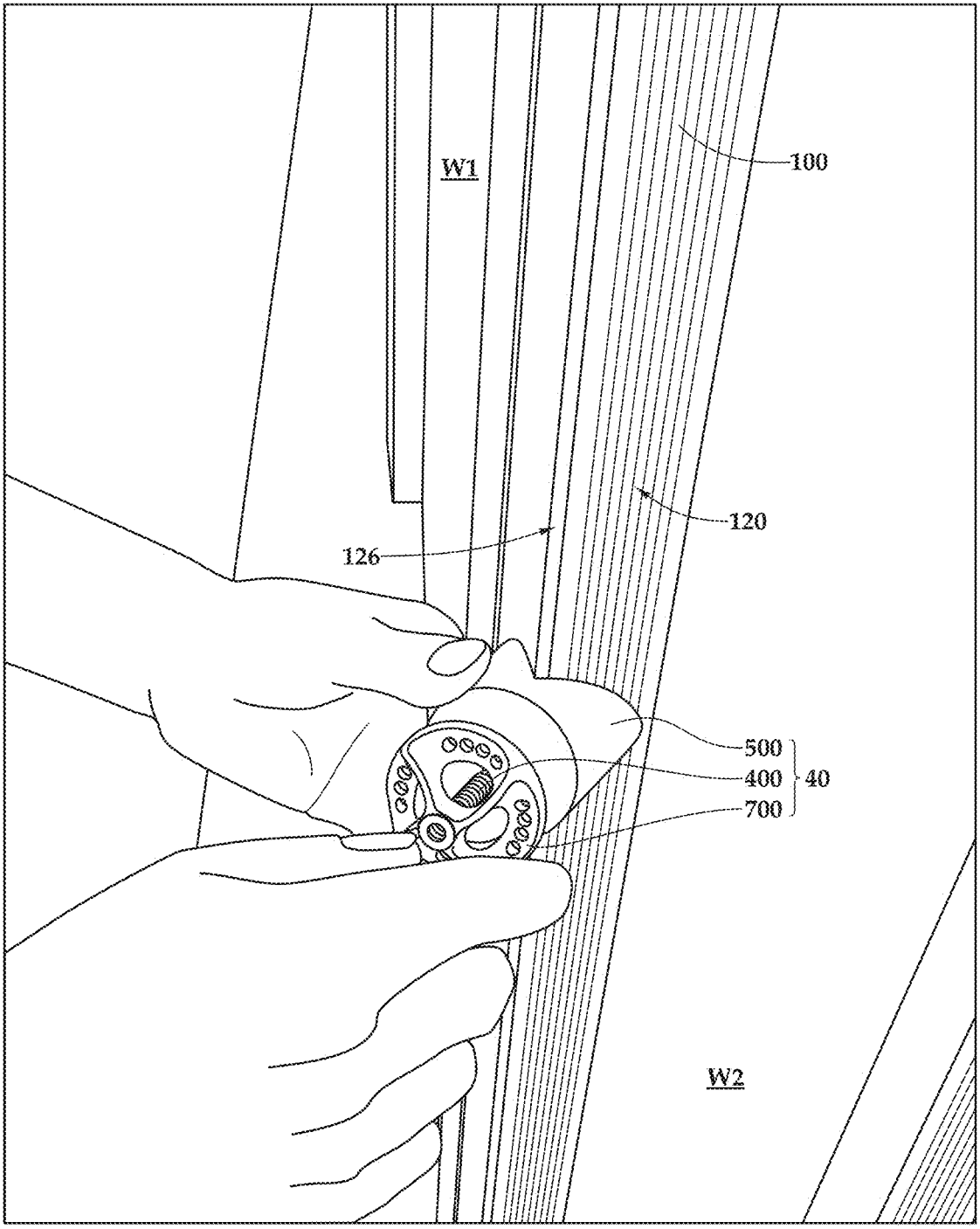
FIG. 12 shows a photograph of a corner anchor being secured to the corner channel of a corner support rail consistent with one embodiment of the present disclosure.
Figure 13:
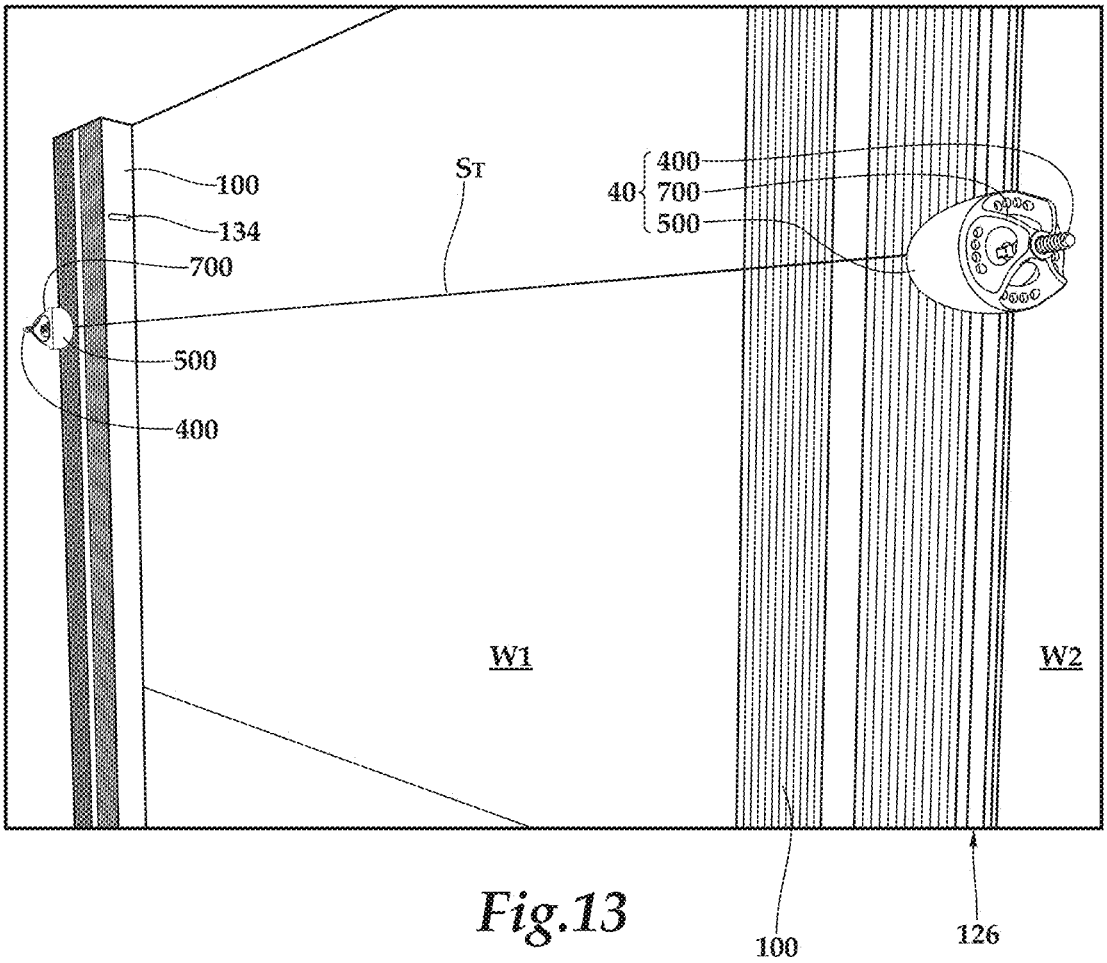
FIG. 13 shows a photograph of two corner channels secured to two adjacent corners of a wall and connected by a string (ST) to define a level surface for mounting a surface support rail therebetween (not shown).
Figure 14:
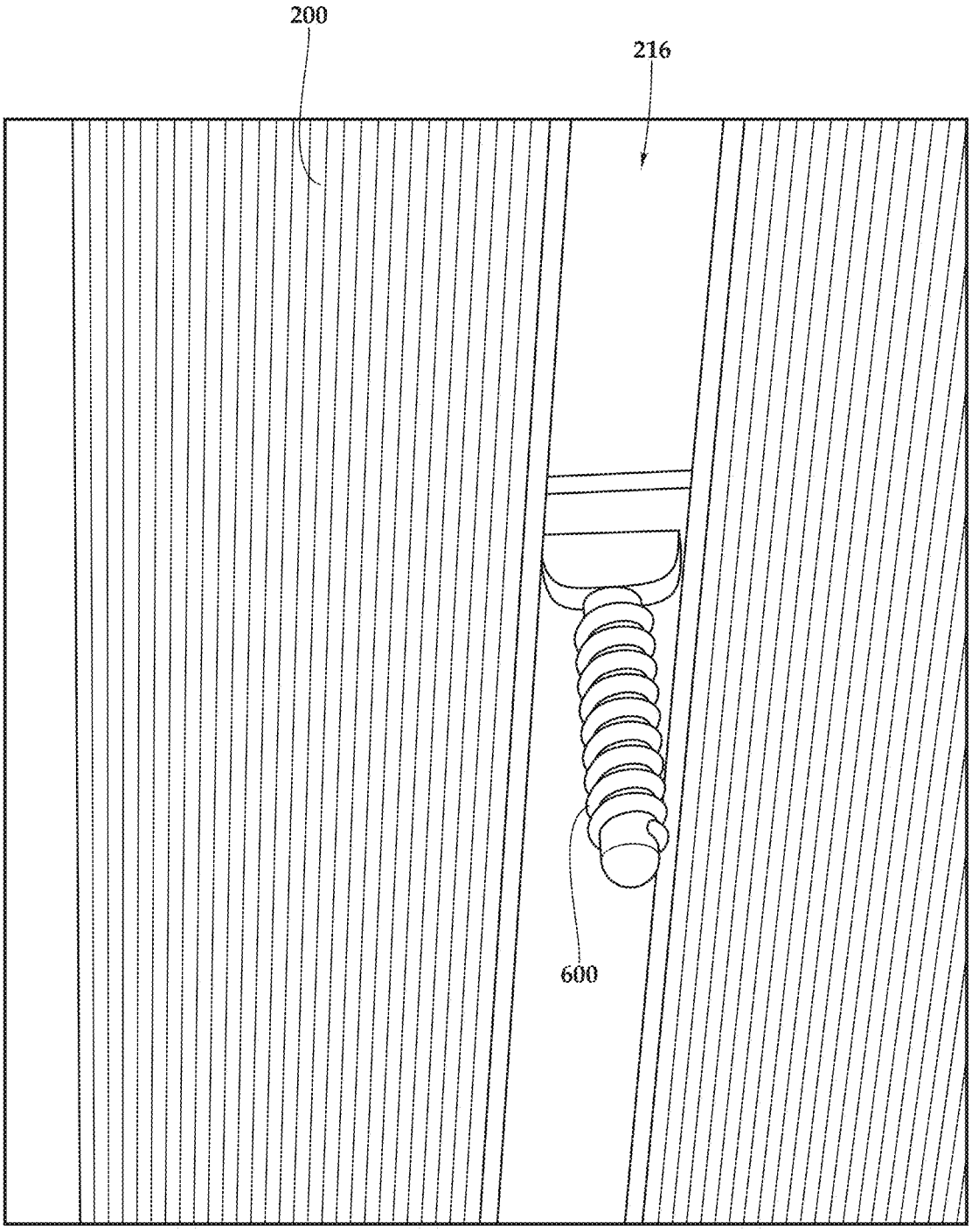
FIG. 14 shows a photograph of a surface channel anchor portion inserted into the surface channel of a support rail consistent with one embodiment of the present disclosure.
Figure 15:
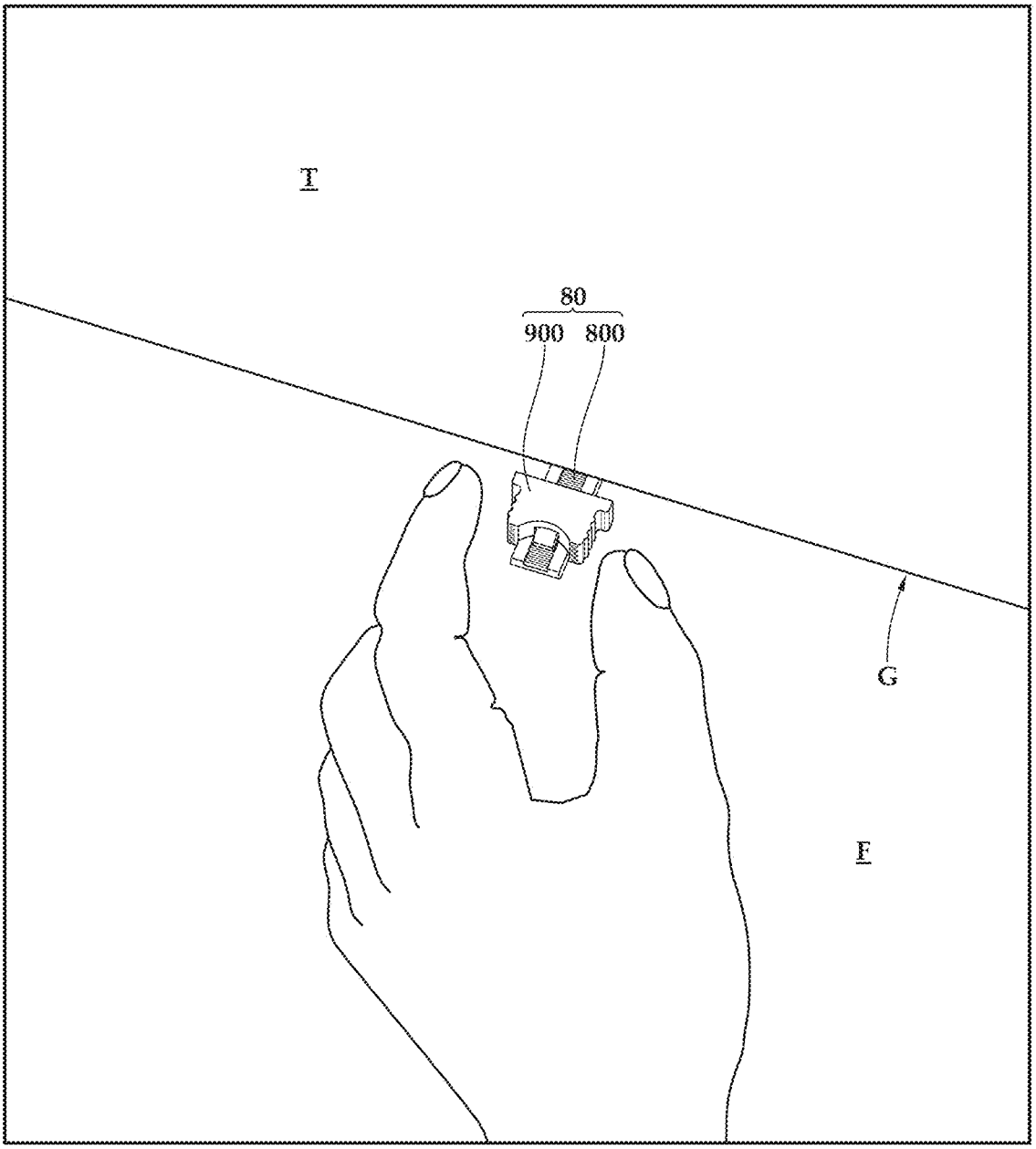
FIG. 15 shows a photograph of another embodiment of a surface channel anchor consistent with the present disclosure being used to secure a tile to a support rail (not visible).
Figure 16:
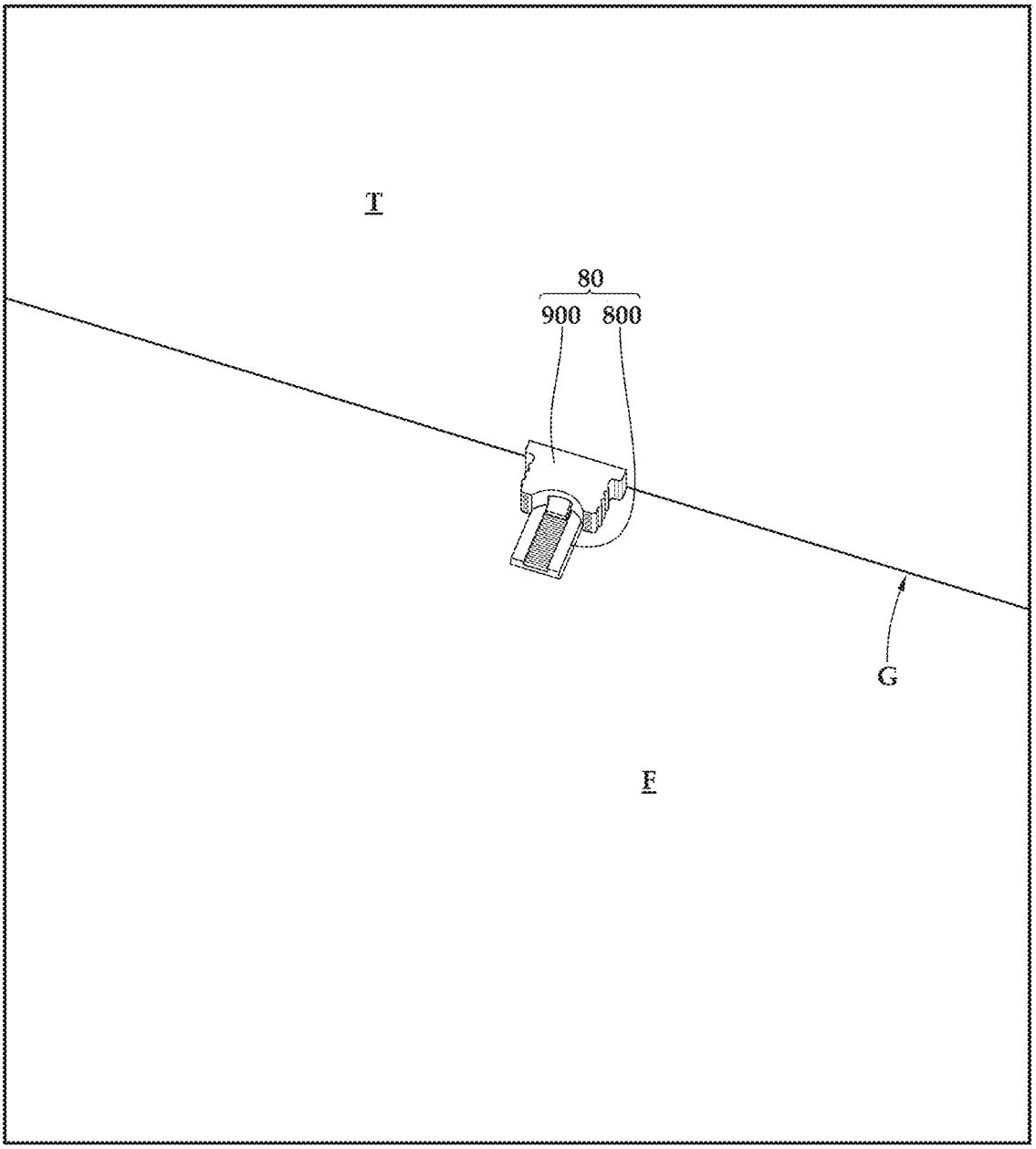
FIG. 16 shows a photograph of the embodiment of FIG. 15 after the locking portion has been advanced to contact the tile.
Figure 17:
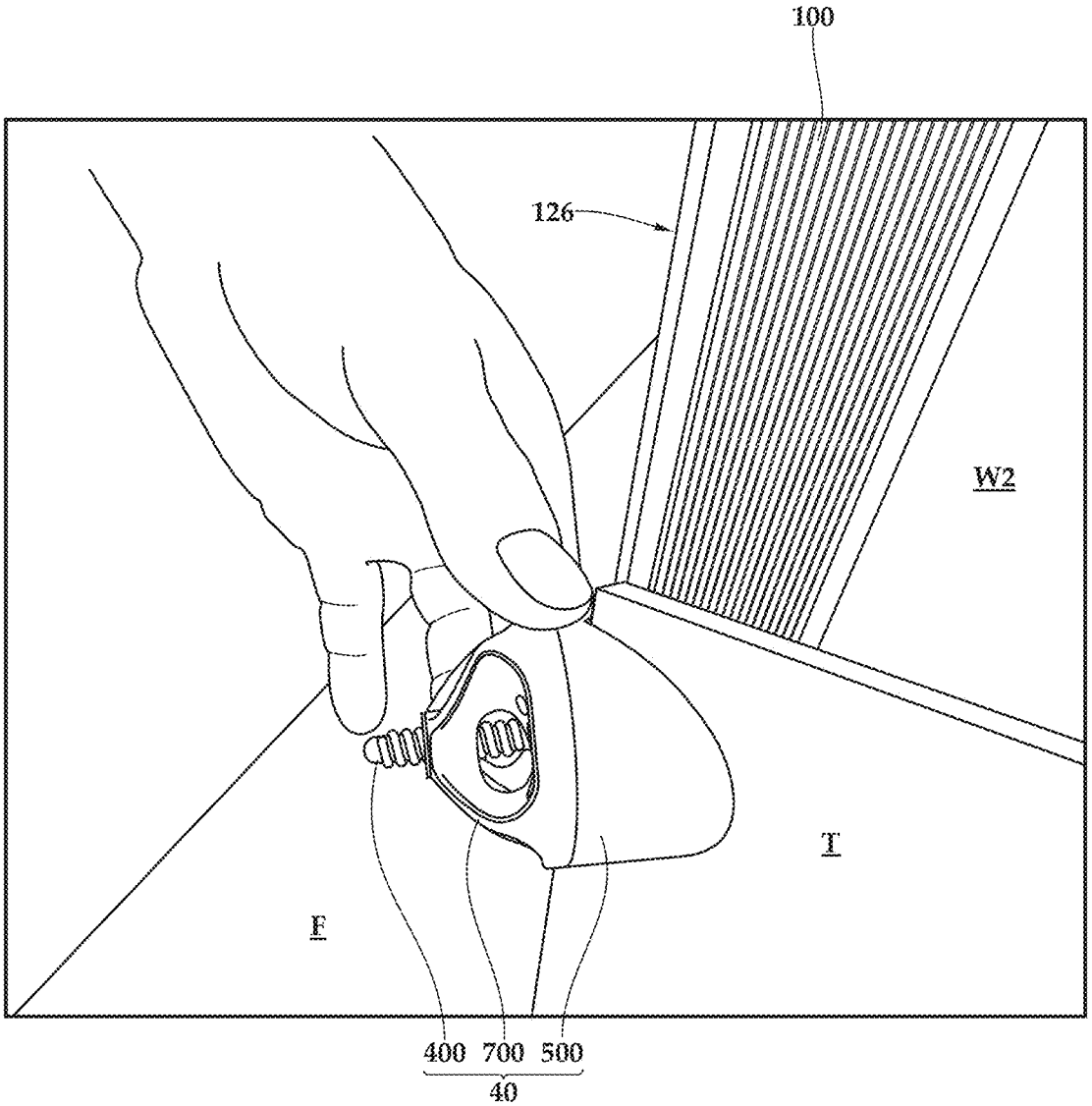
FIG. 17 shows a photograph of a corner anchor being used to secure the edge of a tile to a corner support rail consistent with one embodiment of the present disclosure.
Figure 18:
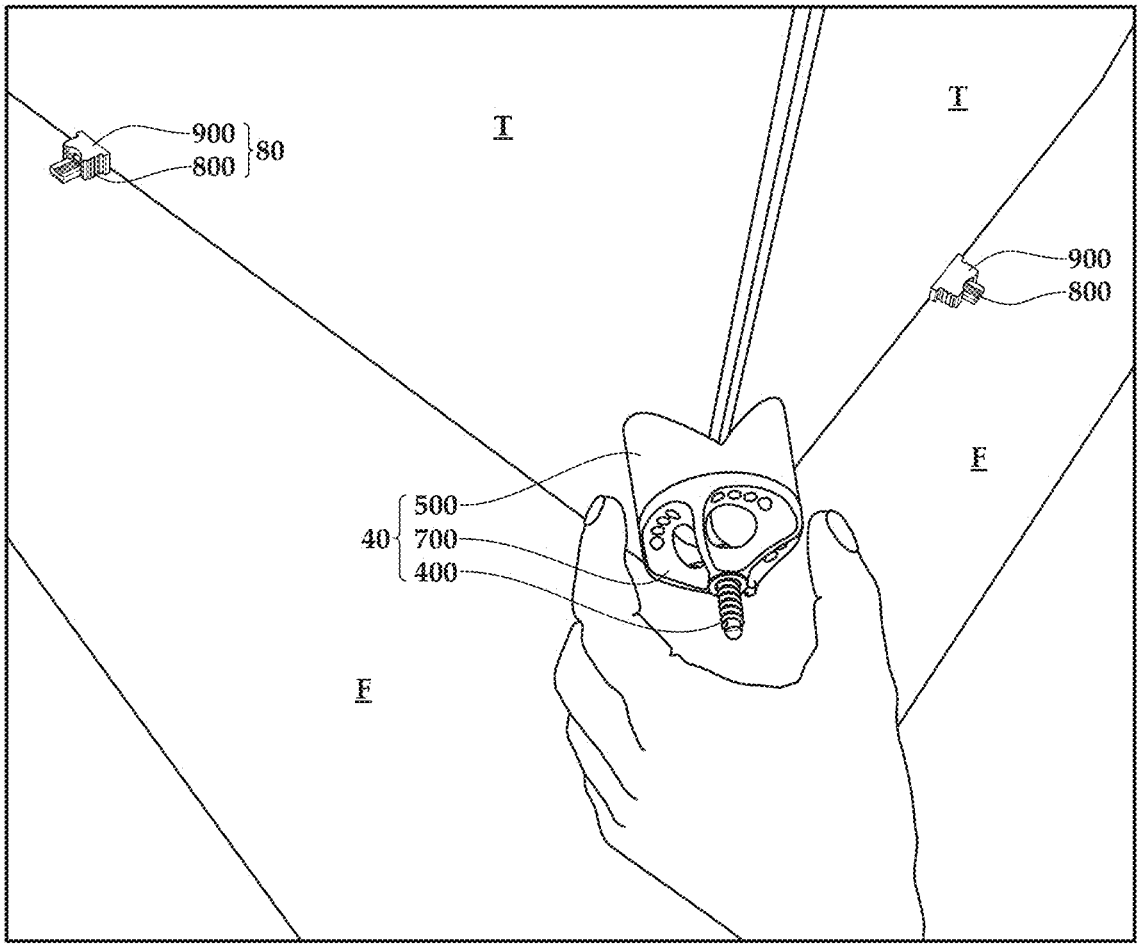
FIG. 18 shows a photograph of the corner anchor of FIG. 17 being used to secure the edge of an adjacent tile to the corner support rail.
Figure 19:
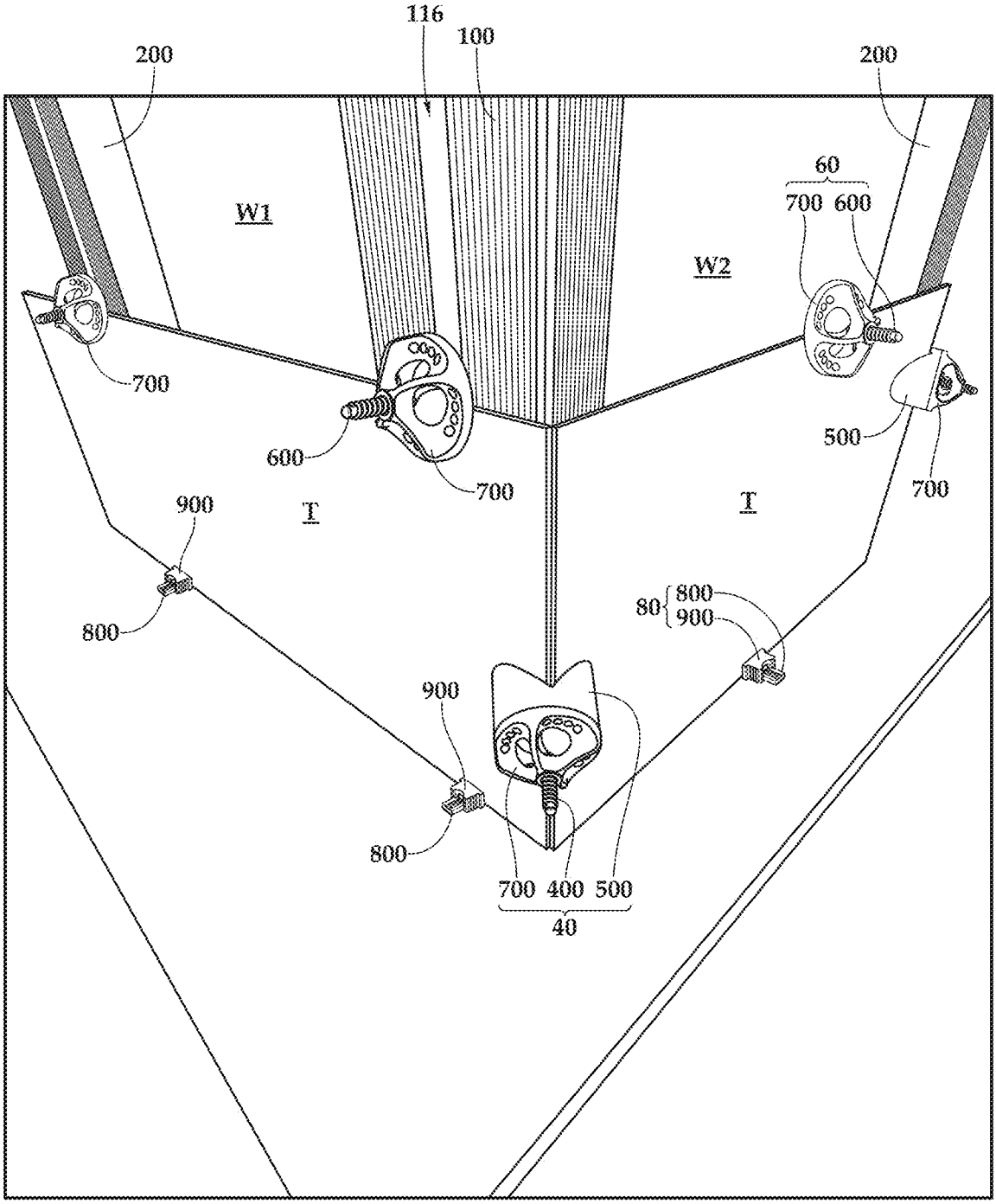
FIG. 19 shows a photograph of two corner anchors and six surface channel anchors being used to secure two adjacent tiles to two corner support rails and two surface support rails consistent with one embodiment of the present disclosure.
Figure 20:
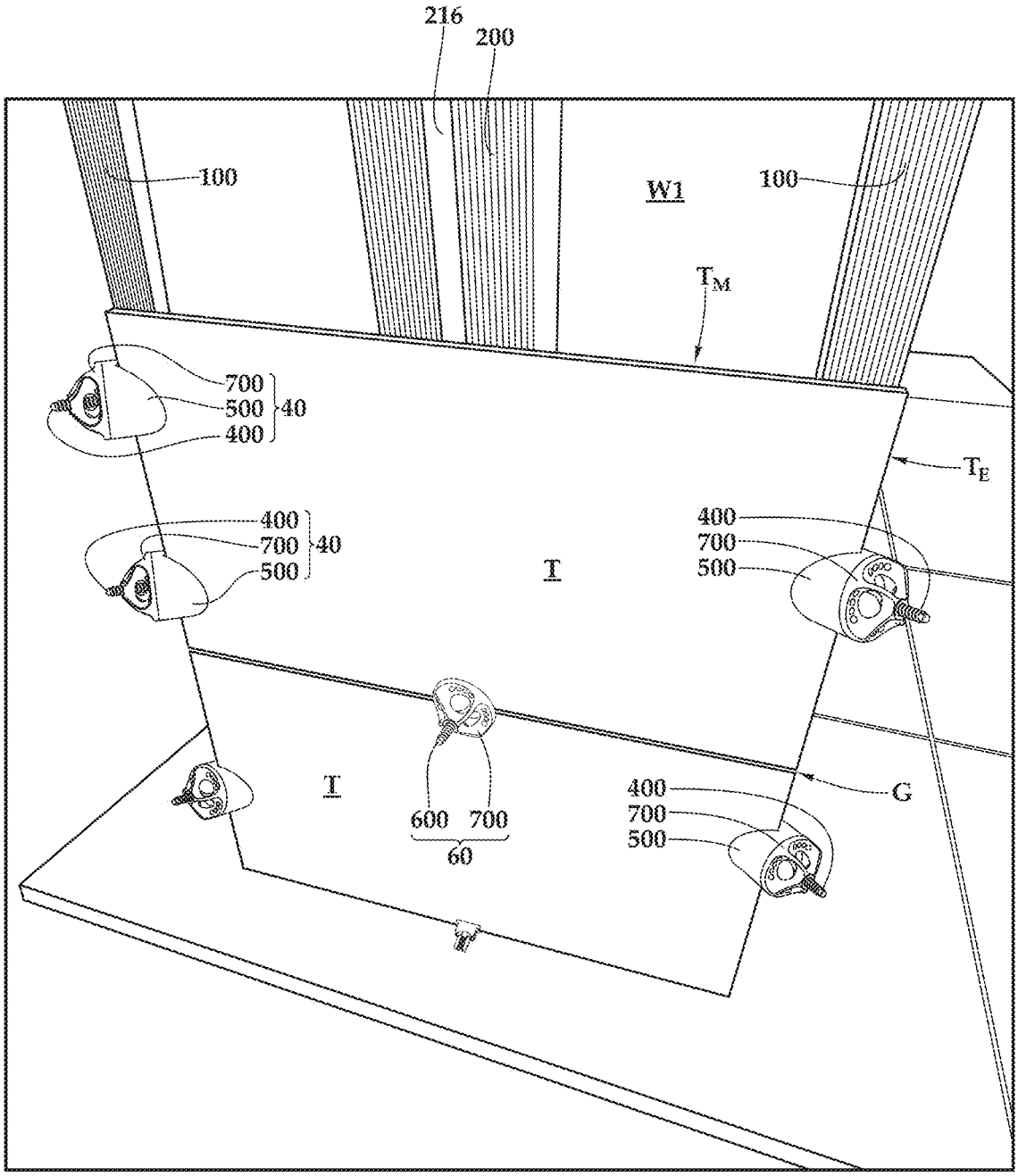
FIG. 20 shows a photograph of five corner anchors and two surface channel anchors being used to secure two adjacent tiles to two corner support rails and one surface support rail consistent with one embodiment of the present disclosure.

In some embodiments, the support rail 100 comprises a surface channel 112 disposed on one face 110, a second face 120 offset from the first face 110 by an angle β. A corner channel 126 is disposed between the first face 110 and the second face 120 and includes a void into which a portion of a corner anchor 400 may be inserted. In the embodiment specifically illustrated in FIG. 22, for example, the second face 120 is offset from the first face 110 by an angle β of about 90°; such a support rail 100 may be particularly useful for mounting tiles T at a corner C of two walls W1, W2, such as shown in FIGS. 17-20 (vertical corner between a first wall W1 and a second wall W2) or such as shown in FIGS. 2-5 (vertical and horizontal corners between a wall W1 and a window opening). For example, FIG. 12 shows a temporary corner anchor 40 disposed in the corner channel 126 of a support rail 100 that is secured about a corner between a first wall W1 and a second wall W2. The corner channel 126 may have any suitable cross-sectional shape for receiving a portion of a corner anchor 400. For example and without limitation, the corner channel specifically shown in FIG. 22 has a V-shaped cross-sectional shape for receiving a portion of a corner anchor 40 that includes two lateral prongs 416.

Figure 22:
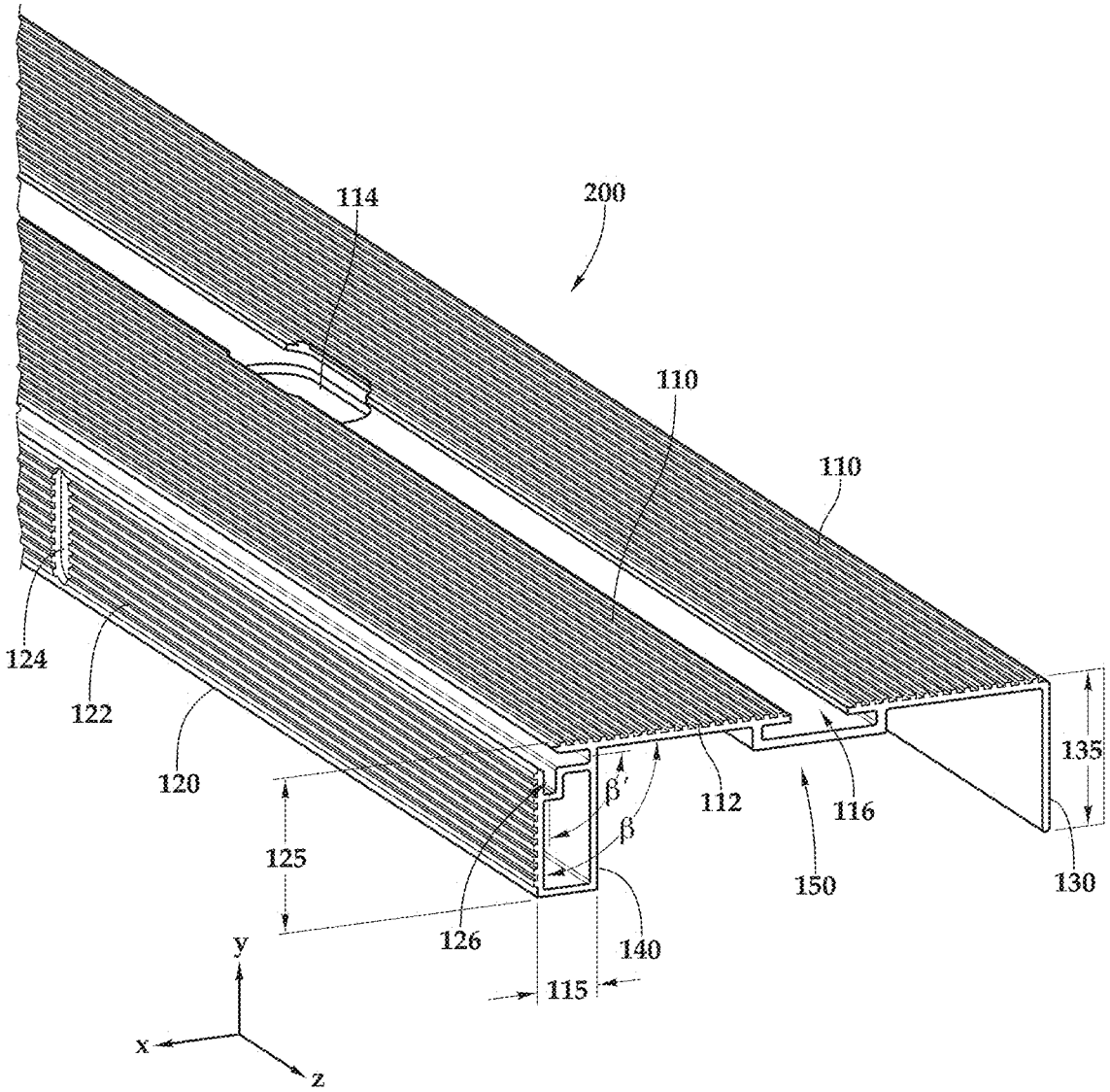
FIG. 22 shows a perspective view of a portion of a corner support rail consistent with one embodiment of the present disclosure.

The first face 110 may include a surface texture 112 configured to enhance purchase of the support rail 100 to a tile adhesive such as mortar or construction adhesive. For example and without limitation, the embodiment specifically shown in FIG. 22 illustrates a surface texture 112 on the first face 110 including a series of undulations or grooves into which the tile adhesive can be pressed when the tile T is advanced toward the first surface 110.

The first face 110 includes a surface channel 116 configured to receive at least a portion of a surface anchor 600. For example and without limitation, the surface channel 116 shown specifically in FIG. 22 runs substantially all or all of the length of the support rail 100 and includes a T-shaped cross section for receiving a portion of a surface anchor 600.

The first face 110 may include a hole 114, such as an elongated hole, configured to allow complete passage of an anchor such as a screw, a nail, a bolt, or similar.

The second face 120 may include a surface texture 122 configured to enhance purchase of the support rail 100 to a tile adhesive such as mortar or construction adhesive. For example and without limitation, the embodiment specifically shown in FIG. 22 illustrates a surface texture 122 on the second face 120 including a series of undulations or grooves into which the tile adhesive can be pressed when the tile T is advanced toward the second surface 120.

The second face 120 includes an elongated opening 124 configured to receive a portion of, but not allow complete passage of, an anchor such as a screw.

The second face 120 may be offset by a predetermined distance 115 from an interior panel 140. The predetermined distance 115 may in some embodiments be about as large as or slightly larger than the width of the corner channel 126.

The second face 120 has a width 125 sufficient to provide a stable surface on which to mount at least a portion of a tile T.

The third face 130 is disposed opposite the second face 120 and may optionally include a surface texture (not shown). In other embodiments, the third face 130 does not include a surface texture. The third face 130 has a width 135 substantially equal to or equal to the width 125 of the second face 120. The third face 130 includes an elongated opening 134 opposite the elongated opening of the second face 120 configured to receive a portion of, but not allow complete passage of, an anchor such as a screw. The elongated opening 134 may extend across substantially all of the width 135 of the third face 130.

Figure 23:
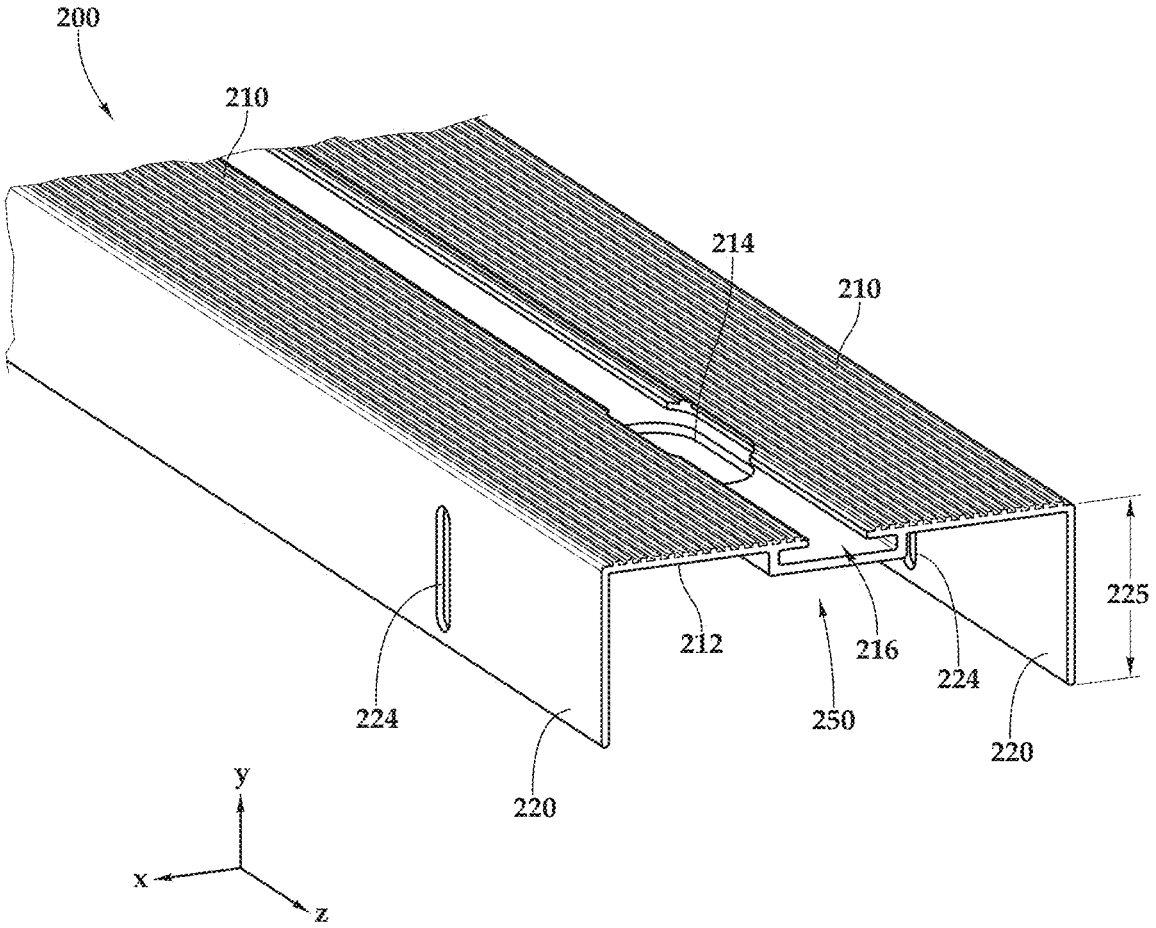
FIG. 23 shows a perspective view of a portion of a surface support rail consistent with one embodiment of the present disclosure.

In other embodiments, a support rail 200 includes only a single face 210 including a surface texture 212 configured to enhance purchase of the support rail 200 to a tile adhesive such as mortar or construction adhesive. For example and without limitation, the embodiment specifically shown in FIG. 23 illustrates a surface texture 212 on the first face 210 including a series of undulations or grooves into which the tile adhesive can be pressed when the tile T is advanced toward the first surface 210.

The face 210 includes a channel 216 configured to receive at least a portion of a surface anchor 600. For example and without limitation, the surface channel 216 shown specifically in FIG. 23 runs substantially all or all of the length of the support rail 200 and includes a T-shaped cross section for receiving a portion of a surface anchor 600.

The face 210 includes a hole or elongated hole 214 configured to enable complete passage of an anchor such as a screw, a nail, a bolt, or similar.

The support rail 200 may include side panels 220 that do not include a texture configured to enhance purchase of the support rail 200 to a tile adhesive such as mortar or construction adhesive. Each side panel 220 may include an elongated hole 224 configured to receive a portion of, but not allow complete passage of, an anchor such as a screw.

Figure 24:
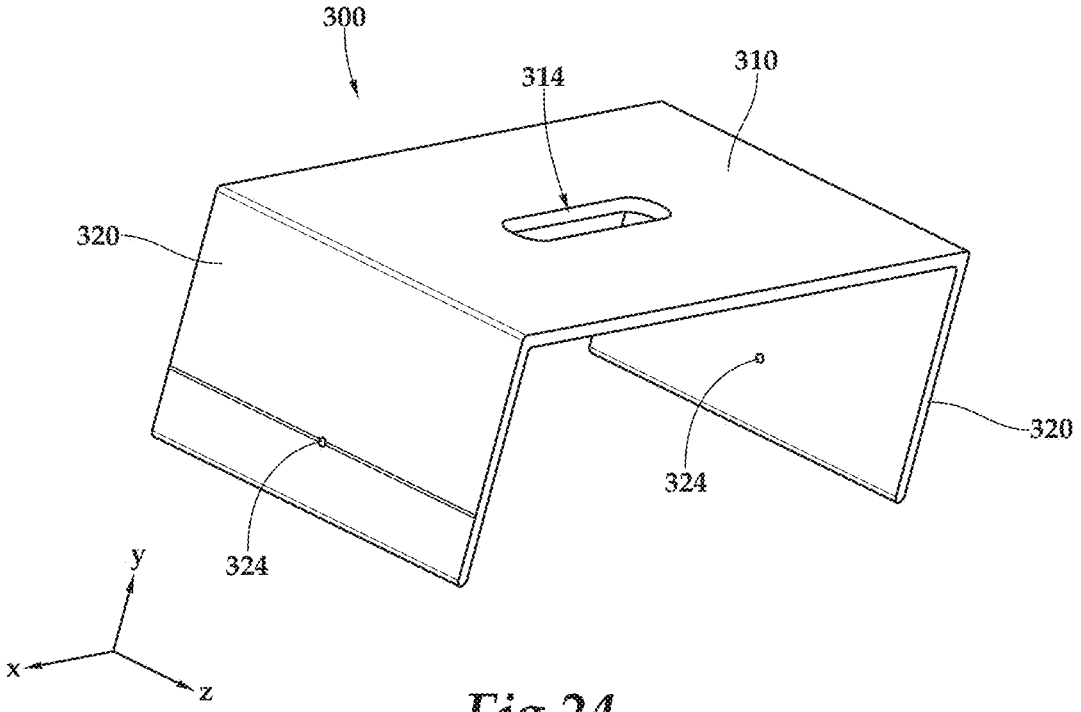
FIG. 24 shows a perspective view of a support rail mount consistent with one embodiment of the present disclosure.

The present disclosure provides support rail mounts 300 configured to secure support rails 100/200 to a surface, such as a wall, a sill, a floor, or a ceiling. As shown in FIG. 24, for example, the support rail mounts 300 may include a base portion 310 from which one or more side wings 320 extend. The base portion 310 is configured to be secured against the surface (e.g., wall W1, wall W2, floor F, ceiling, etc.) or in close proximity to the surface (e.g., separated by weather proofing material, a furring strip or a shim). The base portion may include a mounting hole 314 configured to receive a portion of, but not allow complete passage of, an anchor 302 such as a screw. In some embodiments, the mounting hole 314 is elongated in a left-right dimension (e.g., along an x-axis) to enable side-to-side adjustment of the location of the support rail mount 300 on the surface.

Each side wing 320 may include a hole 324 configured to secure an anchor 322 such as a screw, a nail, a bolt, or similar.

In some embodiments, the mounting hole 314 is configured to be in line with the hole 114/214 in the first face 110/210 of the support rail 100/200 when anchors 322 are disposed through the elongated holes 124/134/224 of the support rails 100/200 and into the holes 324 in the side wings 320 of the support rail mount 300.

In operation, a support rail mount 300 may be loosely anchored to the interior space 150/250 of a support rail 100/200, for example by passing a portion of an anchor 322 through the elongated holes 124/134/224 of the support rail 100/200 and into the holes 324 of the support rail mount. Preferably, two or more support rail mounts 300 are loosely anchored to the interior space 150/250 of a single support rail 100/200 to enable convenient leveling and plumbing of the support rail 100/200 to the surface.

The support rail 100/200 may then be loosely secured to the surface (e.g., wall W1) by driving an anchor 302 through the hole 314 of the base portion 310 and into the surface. The support rail 100/200 may then be plumbed in the left-right dimension (x-axis) before driving a second anchor 302 from the hole 314 of the base portion 310 of another support rail mount 300. If necessary, the first anchor 302 may be fully tightened to secure the first support rail anchor 300 to the surface. With the support rail 100/200 now plumbed in the left-right dimension, the support rail can be plumbed in another dimension (e.g., y-axis) by securing the side anchors 322 of one support rail mount 300, adjusting the plumb of the support rail 100/200, and securing the side anchors 322 of a second support rail mount 300.

Figure 10:
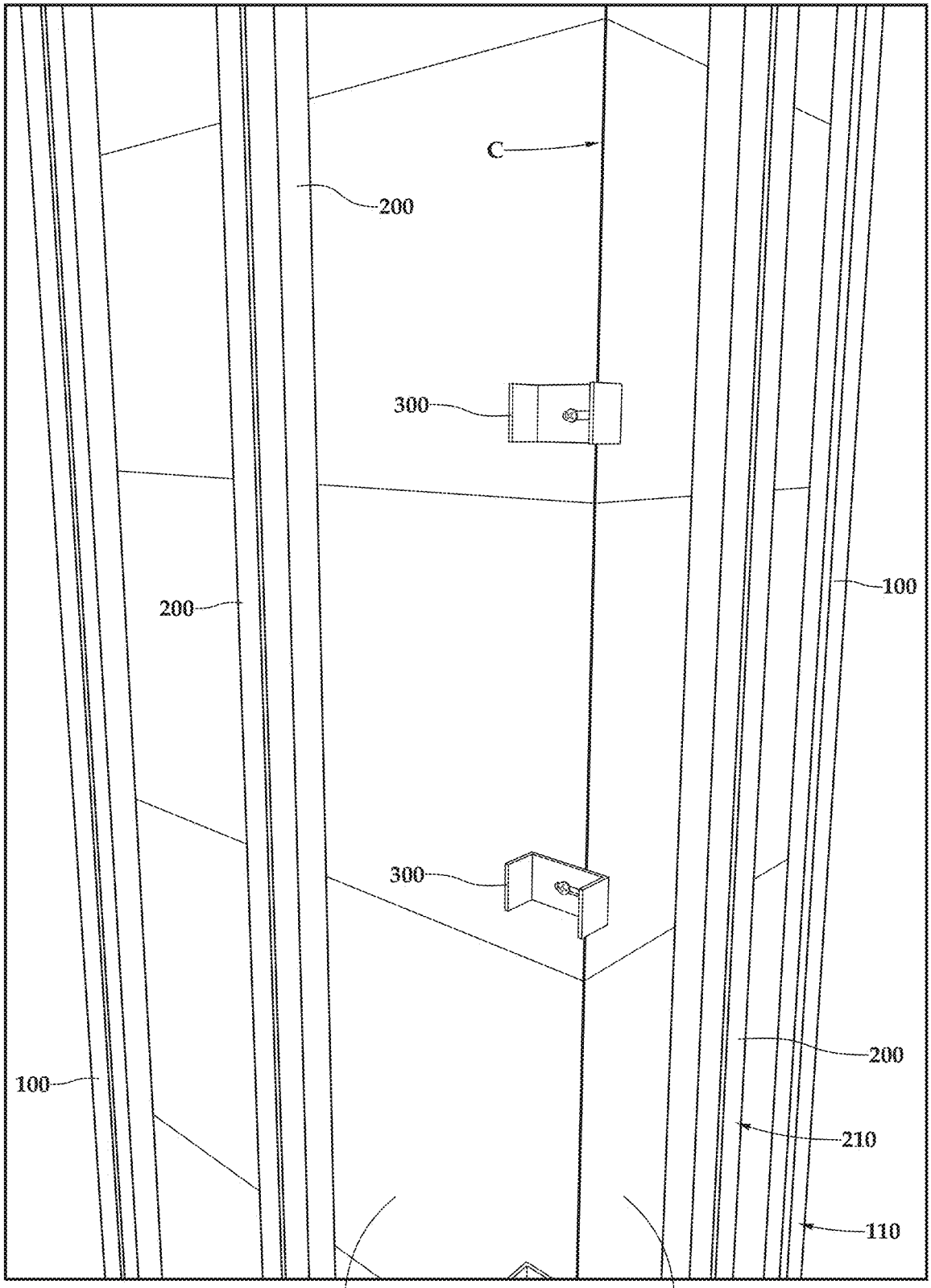
FIG. 10 shows a photograph of several support rails and two support rail mounts secured to two adjacent walls consistent with another embodiment of the present disclosure.
Figure 11:
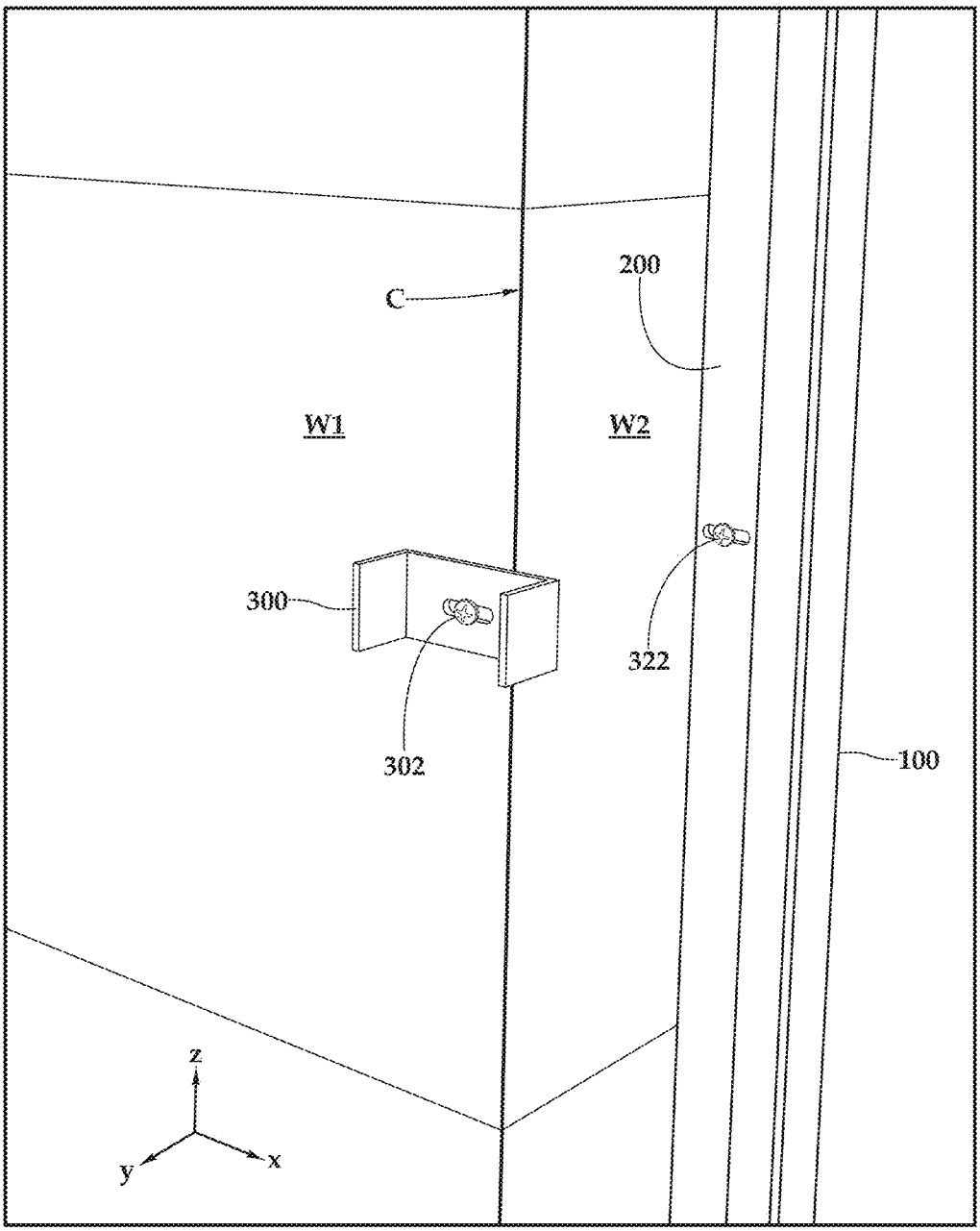
FIG. 11 shows an enlarged photograph of the embodiment of FIG. 10.

In embodiments wherein the support rail 100 is secured to a corner C adjoining two walls W1, W2, the support rail 100 may be affixed to a first wall W1 such that the second face 120 sits proud of the surface of the second wall W2 by a predetermined distance. In some embodiments, the predetermined distance is equal to or substantially equal to the width 125/225 of a support rail 100/200 such that the second face 120 of the support rail 100 is coplanar or substantially coplanar with a face 110/210 of a second support rail 100/200 secured to the second wall W2. One example of this arrangement of multiple support rails 100/200 is shown in FIGS. 10-12. In this example, support rail mounts 300 are disposed at the corner C adjoining two walls W1, W2 such that the support rail mounts 300 extend beyond the surface of the second wall W2 by a distance approximately equal to width 225 of a second support rail 200 secured to the second wall W2. When the corner support rail 100 is secured to the support rail mounts 300 shown exposed in FIGS. 10-11, the second face 120 of the support rail 100 is substantially coplanar with the face 210 of the second support rail 200, and is substantially coplanar with the first face 110 of another corner support rail 100 secured to the next adjacent corner of the second wall W2.

Figure 1:
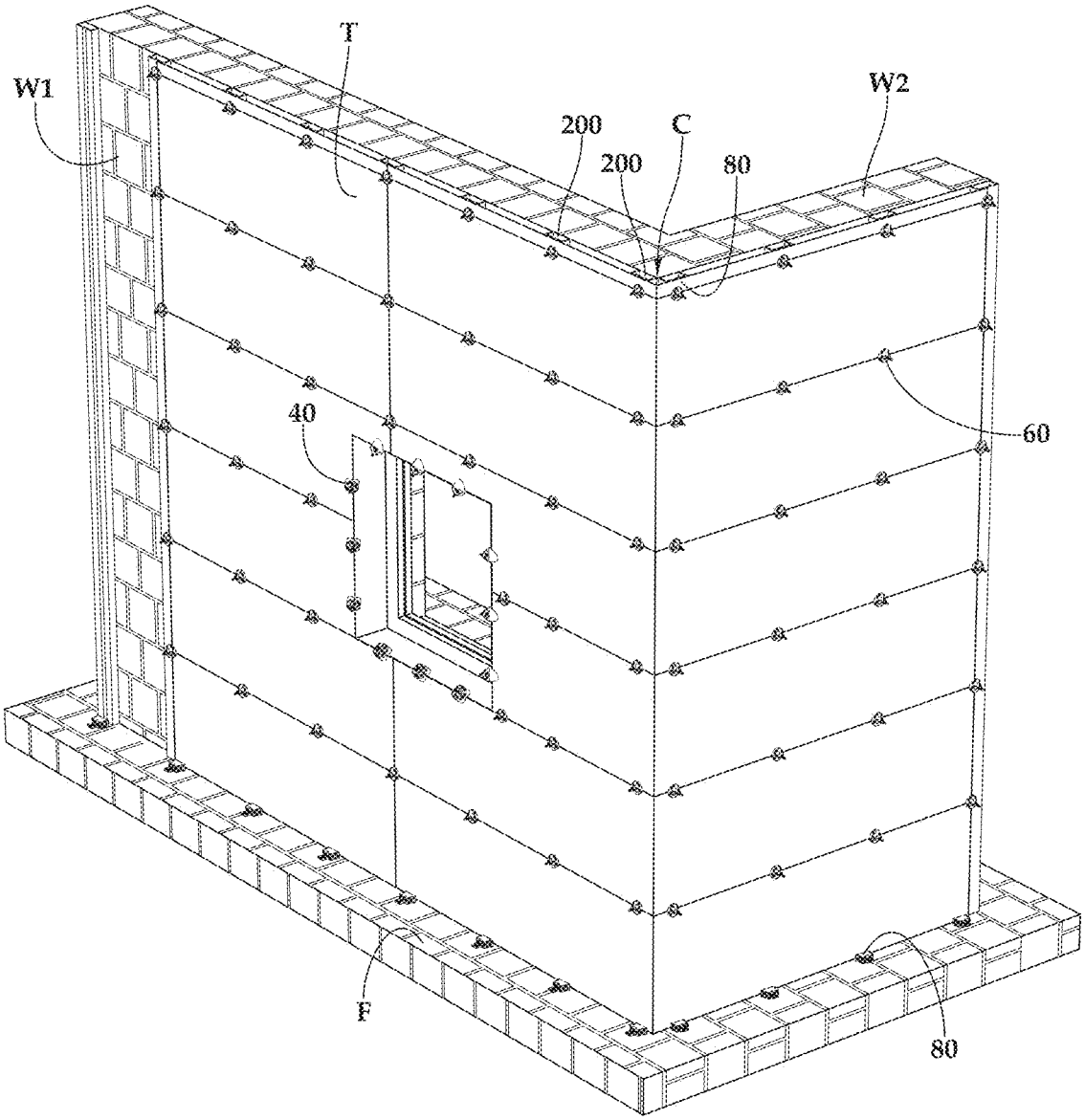
FIG. 1 shows a rendering of a completed portion of a structure including two adjacent walls to which rail supports consistent with one embodiment of the present disclosure are mounted. Tiles are secured to the support rails by one or more channel anchors consistent with one embodiment of the present disclosure.
Figure 2:
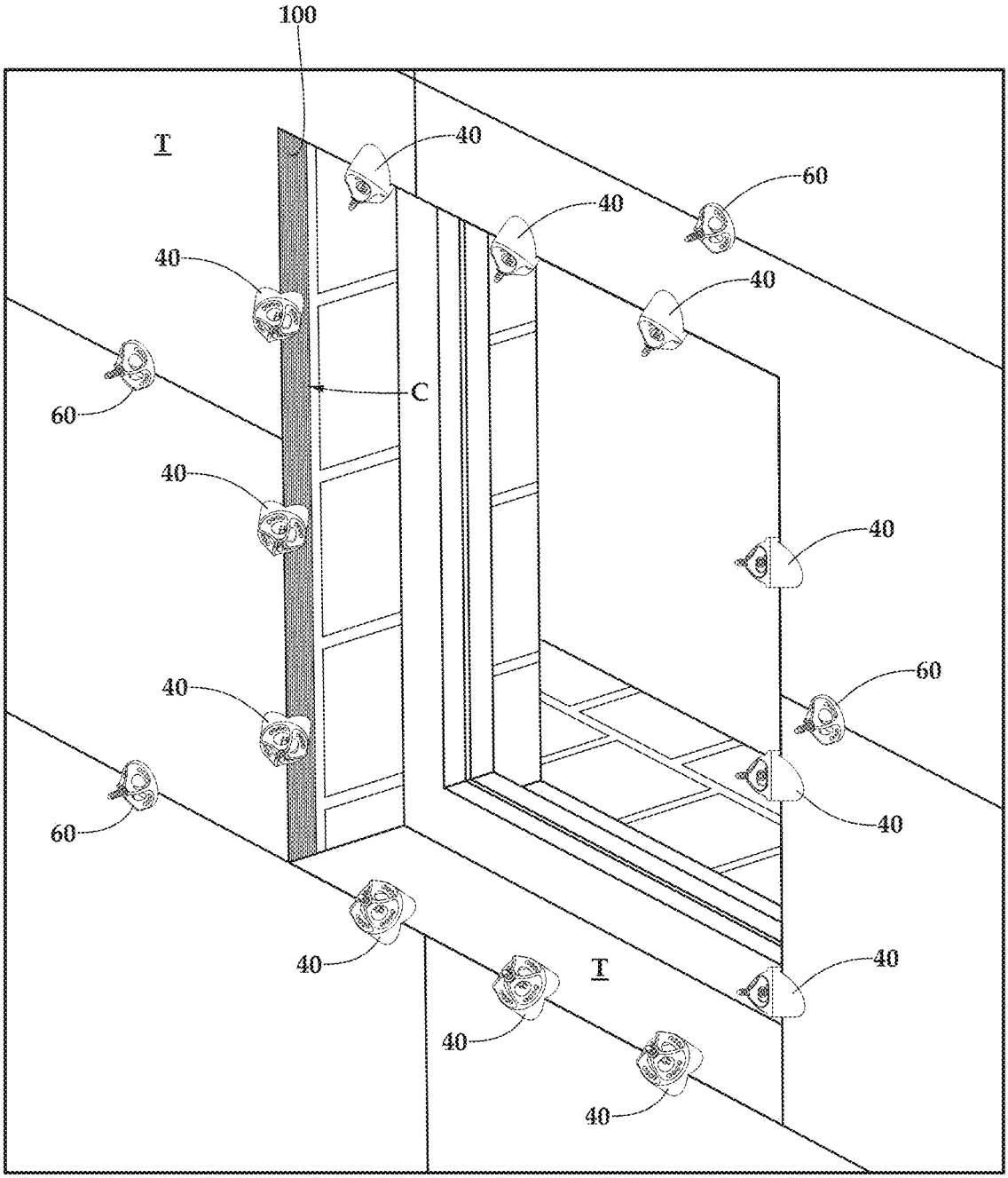
FIG. 2 shows an enlarged and partially transparent view of the window section of the structure of FIG. 1.
Figure 3:
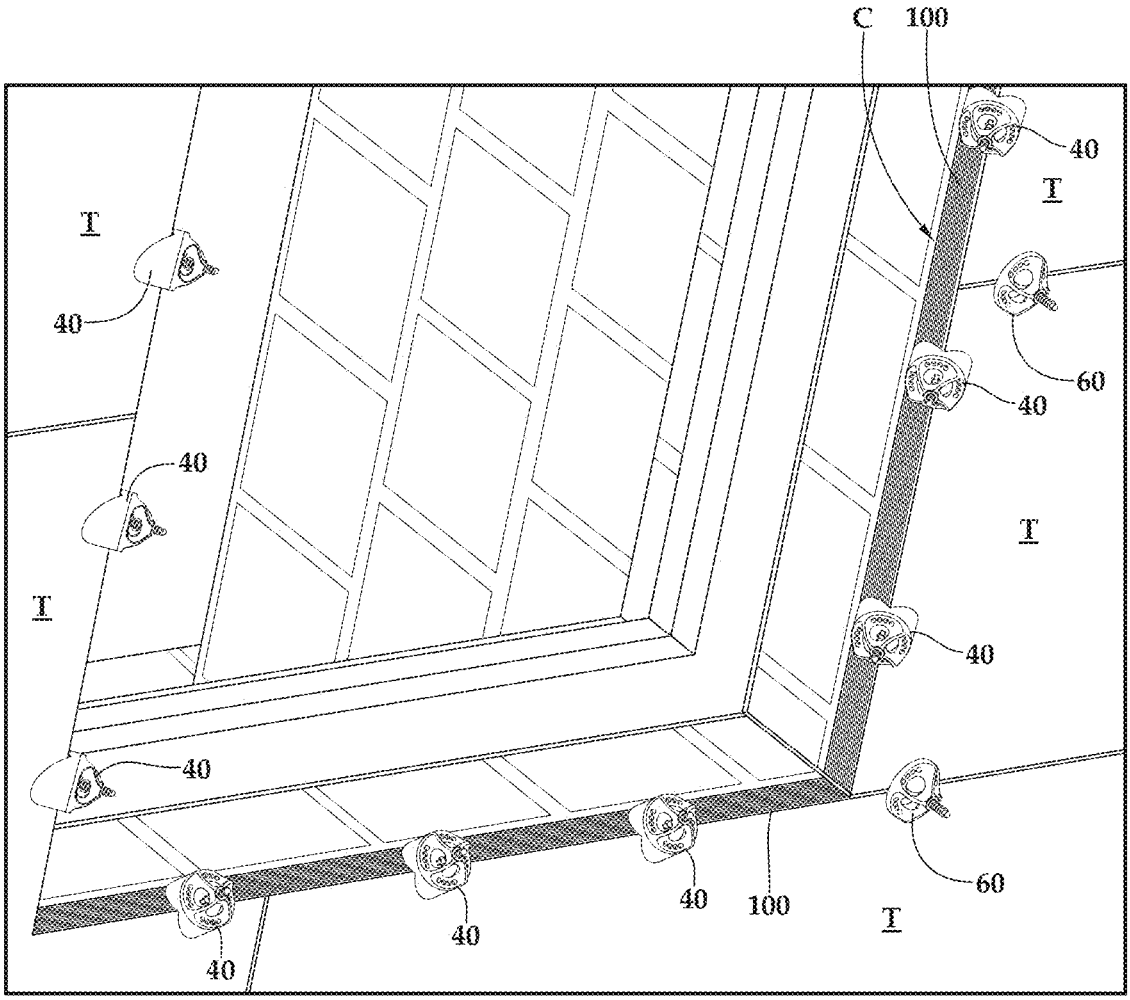
FIG. 3 shows another enlarged and partially transparent view of the window section of the structure of FIG. 1.
Figure 4:
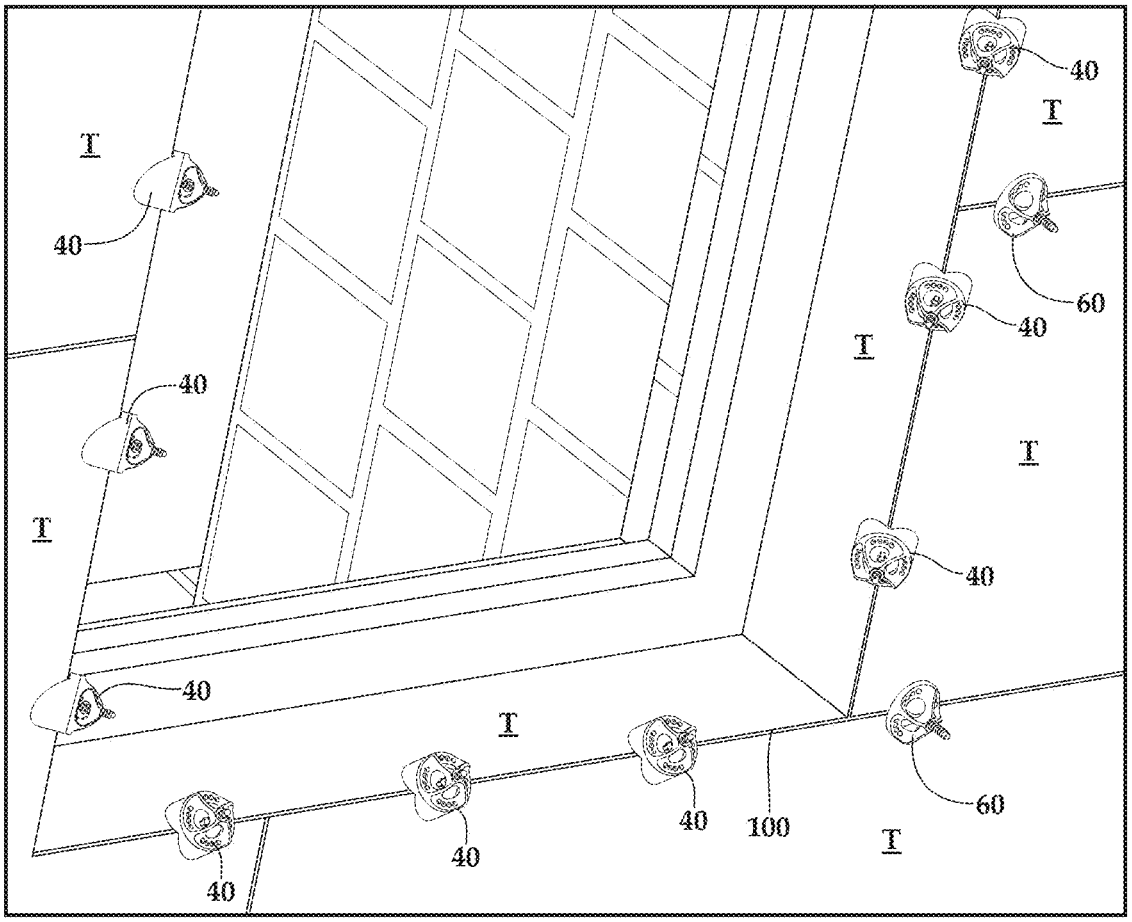
FIG. 4 shows an enlarged view of the window section of the structure of FIG. 1.
Figure 5:
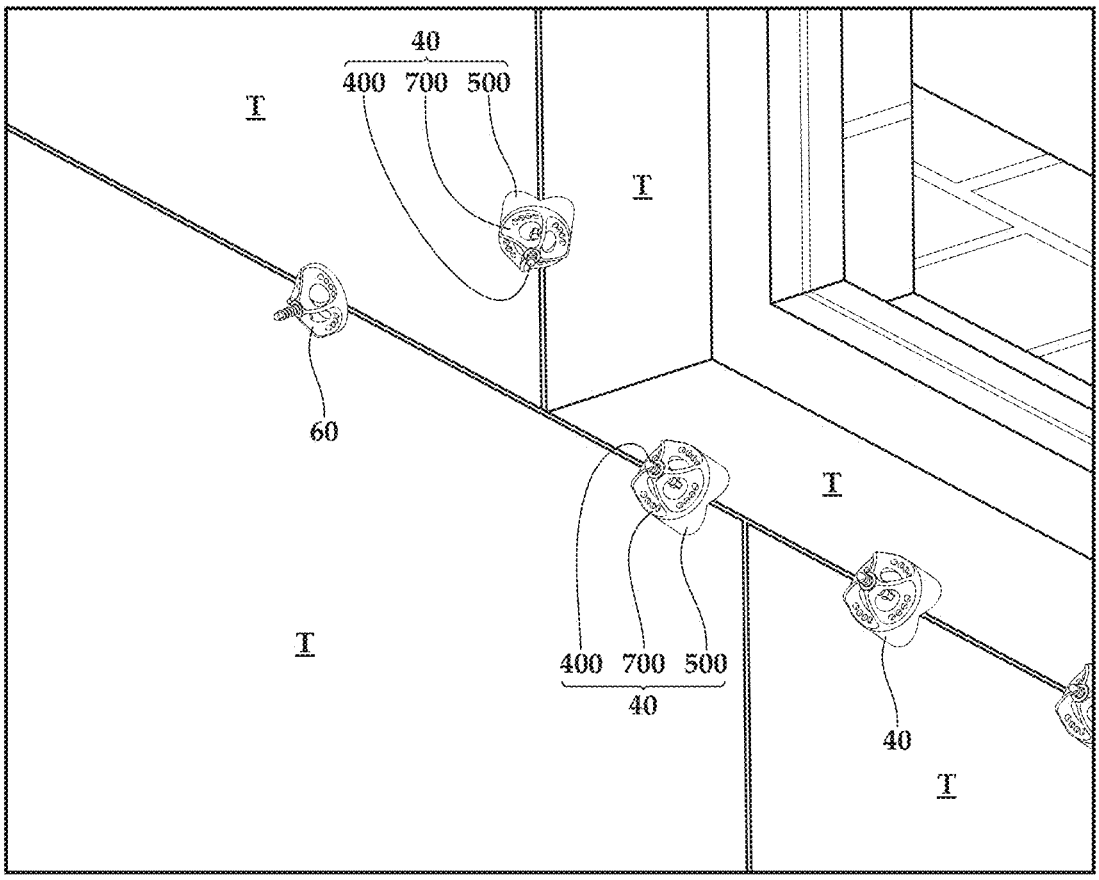
FIG. 5 shows another enlarged view of the window section of the structure of FIG. 1.
Figure 6:
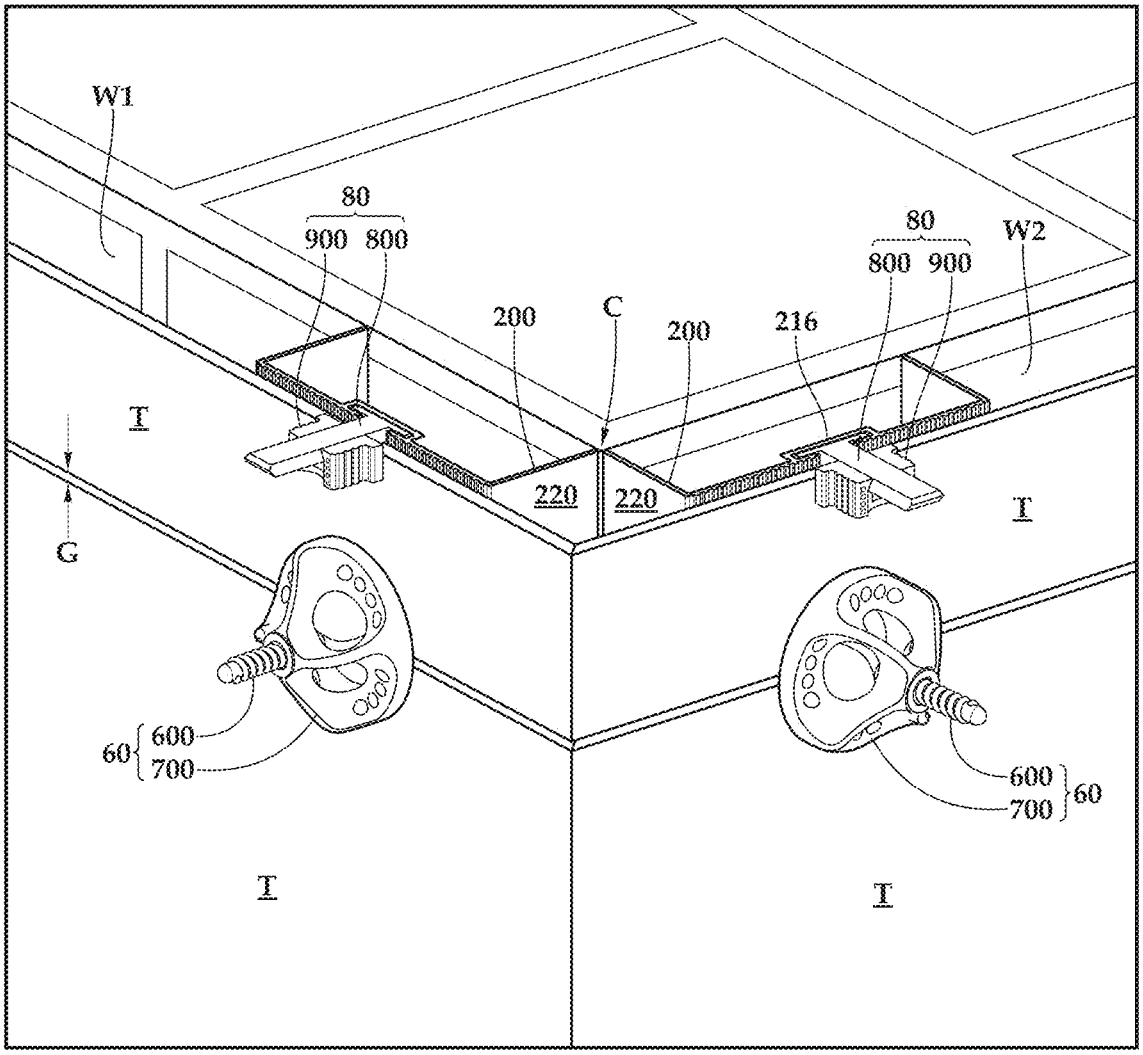
FIG. 6 shows an enlarged view of the top of the corner section of the structure of FIG. 1.
Figure 7:
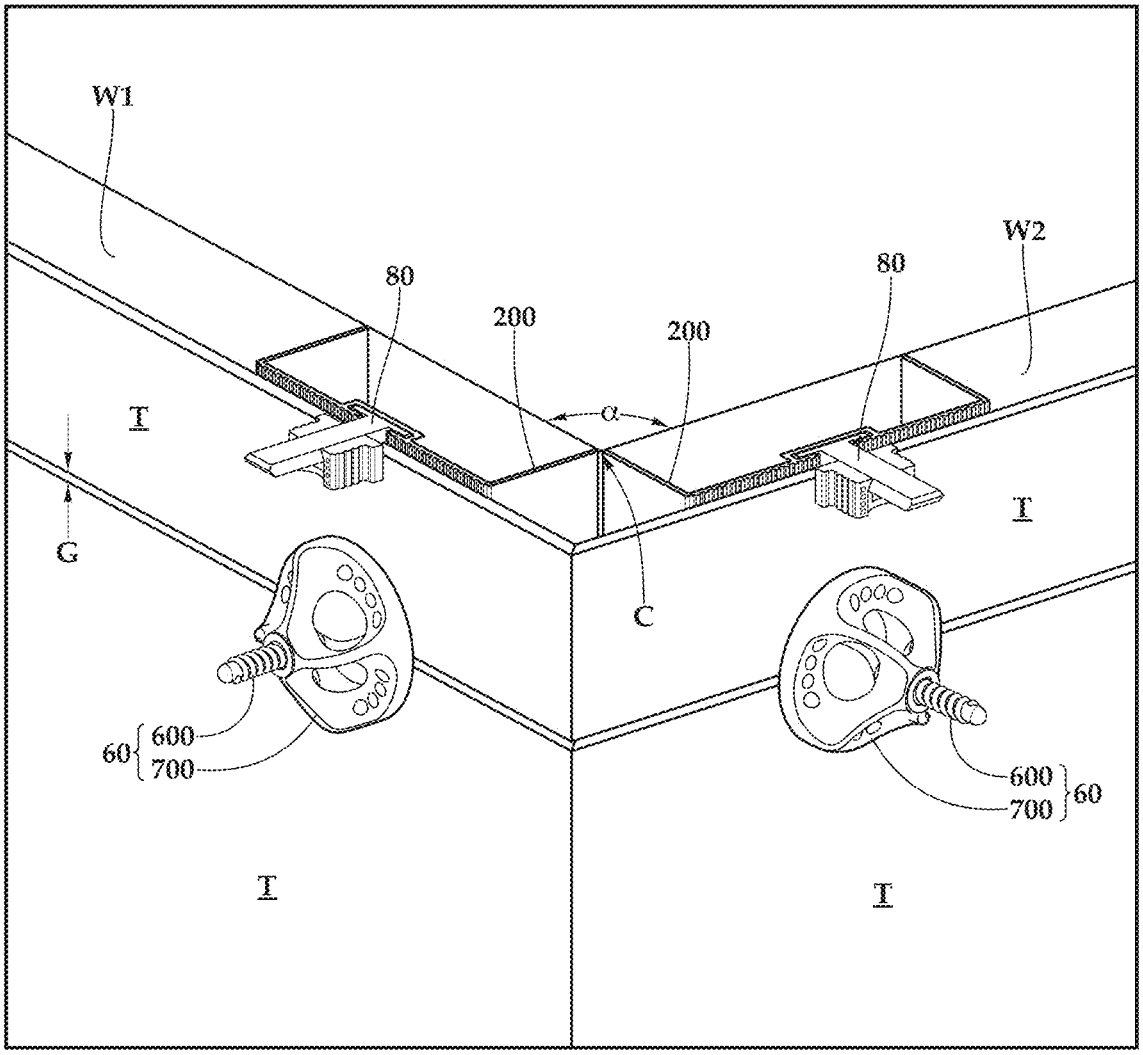
FIG. 7 shows a line art depiction of the view of FIG. 1.
Figure 8:
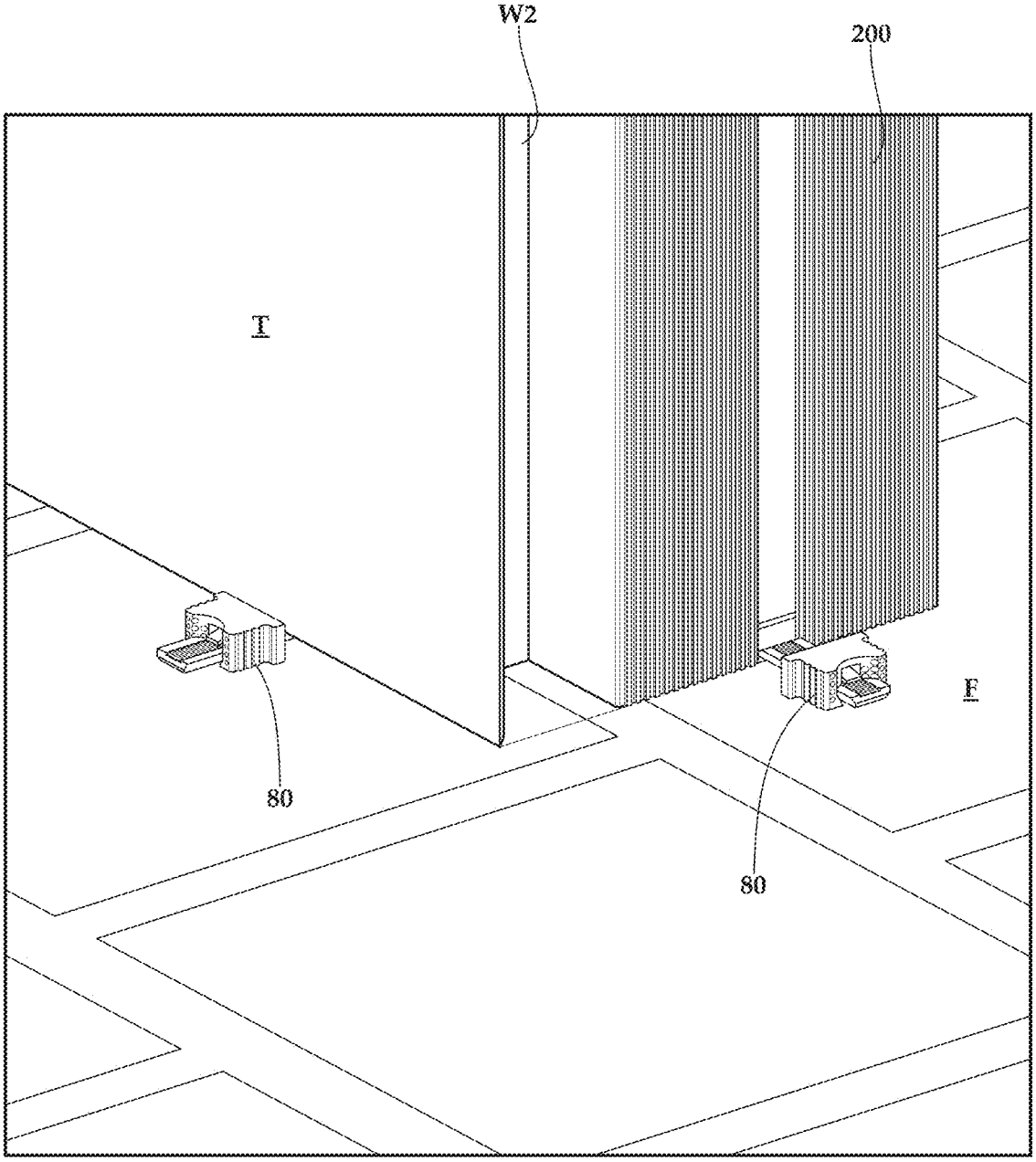
FIG. 8 shows an enlarged and partially transparent view of the structure of FIG. 1 where the corner meets the floor.
Figure 9:
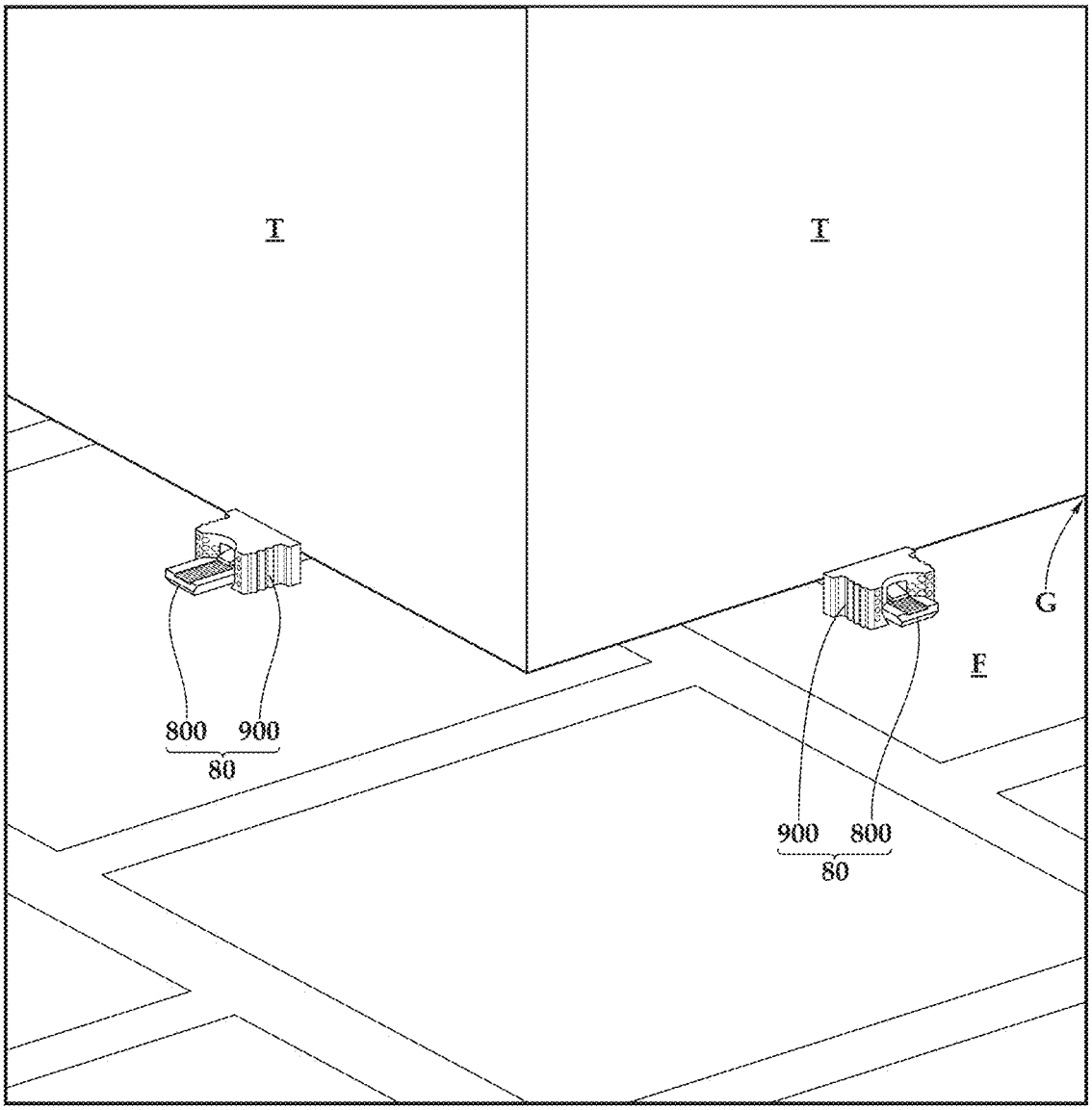
FIG. 9 shows an enlarged view of the structure of FIG. 1 where the corner meets the floor.

In other embodiments, two support rails 200 consistent with FIG. 23 can be used to mount tiles T at a corner C adjoining two walls W1, W2. For example and without limitation, the embodiment shown in FIGS. 1-9 depict two support rails 200 consistent with FIG. 23 to mount tiles T at a corner C adjoining two walls W1, W2. Referring now specifically to FIGS. 6-7, a first support rail 200 is mounted (e.g., using support rail mounts 300, not shown) to a first wall W1 such that one side wall 220 is in close proximity to the corner C. A second support rail 200 is mounted (e.g., using support rail mounts 300, not shown) to a second adjacent wall W2 such that one side wall 220 is in close proximity to the corner C. While this embodiment does not offer the same degree of structural support for the mounted tiles T at their adjacent edges as a corner support rail 100 might provide, this embodiment employing two support rails 200 consistent with FIG. 23 enables mounting of tiles T at connections of two walls W1, W2 that may not form an angle $\alpha$ substantially similar to the angle $\beta$ between the first face 110 and the second face 120 of a corner support rail 100.

Support rails 100/200 may comprise, consist essentially of, or consist of any suitable material that provides, after installation, sufficient rigidity to support the tile T of interest, is resistant to degradation from the tile adhesive (e.g., mortar or construction adhesive), and is resistant to tear-out failure from the surface from weight exerted on the anchors by the tiles T. For example and without limitation, the support rails 100/200 and support rail mounts 300 may comprise, consist essentially of, or consist of aluminum, steel, iron, wood, plastic, or a combination of any two or more of the foregoing.

Mounting Anchors

The present disclosure comprises mounting anchors, such as temporary mounting anchors, for securing tile T to the support rails 100/200 for a temporary period of time. The temporary period of time may, in some embodiments, be sufficient to enable a tile adhesive (e.g., mortar or construction adhesive) disposed between the tile T and the support rail(s) 100/200 to cure.

Generally, mounting anchors consistent with the present disclosure include an anchor portion, a locking portion, and optionally a spacer portion. The anchor portion is configured to mate (e.g., reversibly and/or slidably mate) with a channel 116/126/216 of a support rail 100/200. The locking portion is configured to mate with the anchor portion to exert a compression force between the tile T and the support rail 100/200. The spacer portion, when present, enhances exertion of the compression force by the locking portion.

Figure 25:
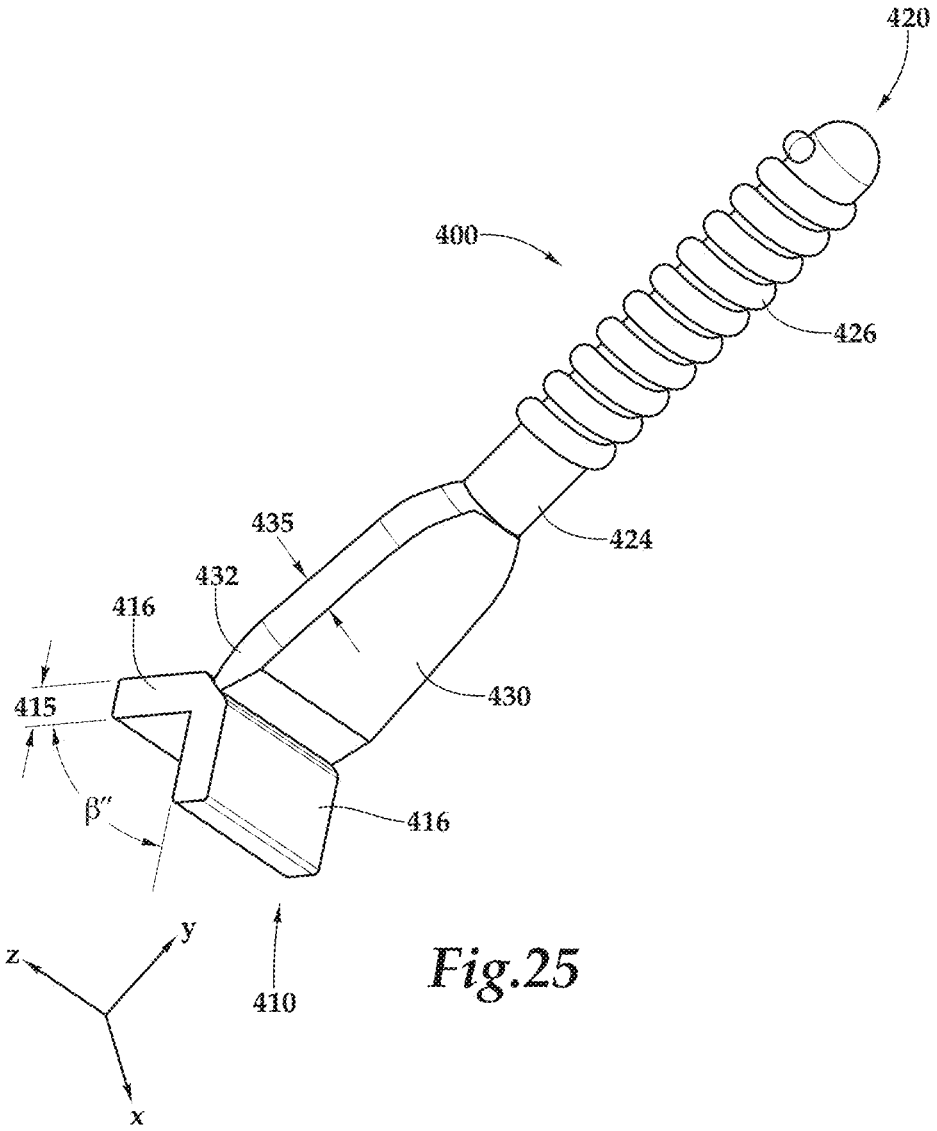
FIG. 25 shows a perspective view of a corner anchor portion consistent with one embodiment of the present disclosure.

One example of a channel anchor 40 consistent with the present disclosure is shown FIGS. 1-5, 12-13, and 17-20. In this example embodiment, the channel anchor 40 includes a channel anchor portion 400, an angular spacer portion 500, and a locking portion 700. Referring now to FIG. 25, the channel anchor portion 400 includes a head portion 410 configured to mate with the corner channel 126 of a corner support rail 100. The head portion 410 in this embodiment includes two lateral prongs 416 extending away from the spacer portion 430 to form an angle β" that is substantially similar to the angle β' formed by the subchannels of the corner channel 126 of a corner support rail 100. Each lateral prong 416 of the head portion 410 may have a thickness 415 that is less than the corresponding inner dimension of the subchannels of the corner channel 126.

The stem portion 420 is disposed opposite the head portion 410 and is configured to releasably mate with a locking portion 700. For example and without limitation, the stem portion 420 of the embodiment specifically shown in FIG. 25 includes threads 426 configured to complement threads 726 of an anchor lock 700.

The spacer portion 430 is disposed between the head portion 410 and the stem portion 420, and has a predetermined thickness 435 (e.g., maximum thickness) that defines the gap G between adjacent tiles T. In some embodiments, the thickness 435 that determines the gap G between adjacent tiles T is orthogonal to the axis along which the head portion 410 is configured to slide within the corner channel 126.

The spacer portion 430 may include a relatively narrow head attachment portion 432 configured to break away from the head portion 410 when a force exceeding a minimum threshold force is applied to the stem portion 420 or to the spacer portion 430. For example and without limitation, the head attachment portion 432 may have a thickness (e.g., average thickness, median thickness, or maximum thickness) less than the thickness 435 of the spacer portion 430 that determines the gap G between adjacent tiles T. In such embodiments, the head attachment portion 432 enables convenient release of the spacer portion 430 from the head portion 410 to remove any portion of the corner anchor 400 that extends beyond the tile T, for example after the tile adhesive has cured. By removing all or substantially all of the spacer portion 430 from the gap G, grout or other fill can be conveniently applied between adjacent tiles T without unsightly spacers remaining visible or obstructing application of grout or fill between adjacent tiles T.

Figure 26:
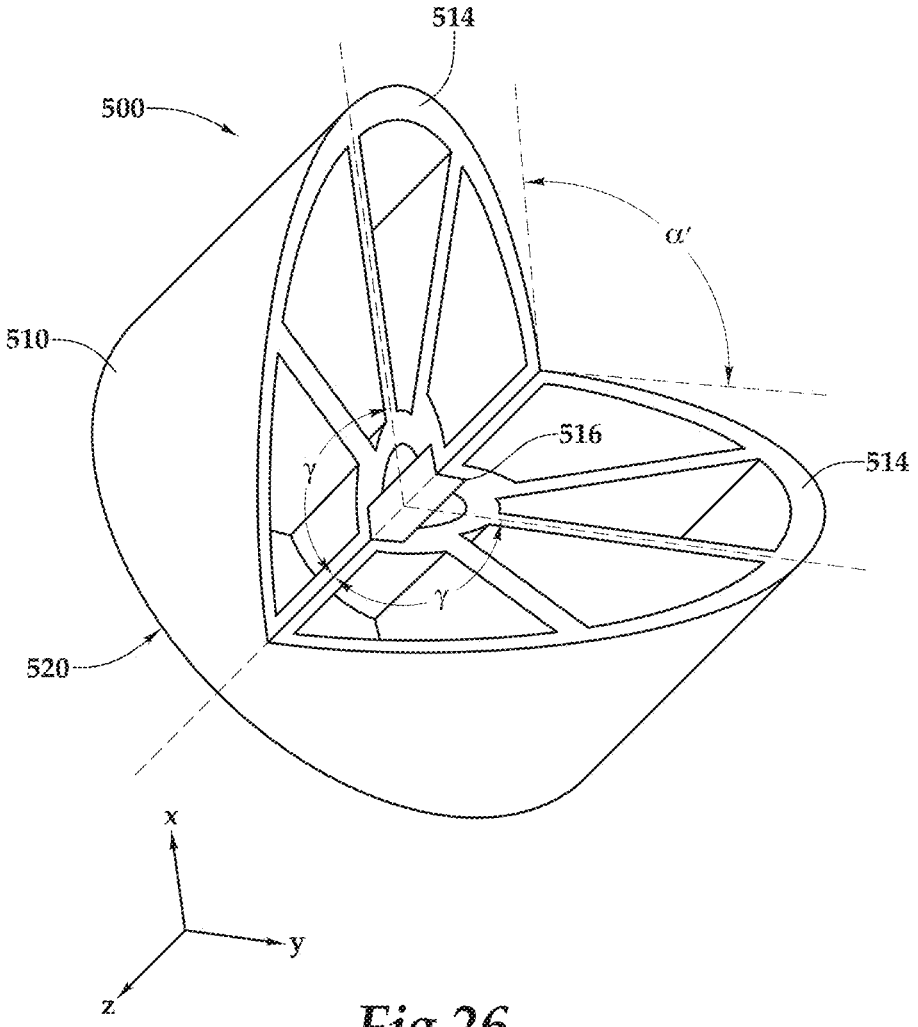
FIG. 26 shows a perspective view of an angled spacer portion consistent with one embodiment of the present disclosure.

Referring to FIG. 26, the angular spacer portion 500 includes an angled face 514 and a lock face 520 disposed opposite the angled face 514. The lock face 520 is generally flat and configured to abut the locking portion 700. The angled portion 514 is disposed opposite the lock face 520 and defines an angle α' that is substantially similar to the angle α formed by the adjacent walls W1, W2. An orienting hole 516 is disposed from the lock face 520 to the angled face 514 and at the apex of the angle α'. The orienting hole 516 enables the stem portion 420 and at least a portion of the spacer portion 430 of the channel anchor portion 400 to pass therethrough. In some embodiments, the orienting hole 516 includes a cross-sectional shape complementary to the cross-sectional shape of the spacer portion 430 to orient the angled portion 514 and its defined angle α' relative to the thickness 435 of the spacer portion 430.

Figure 28:
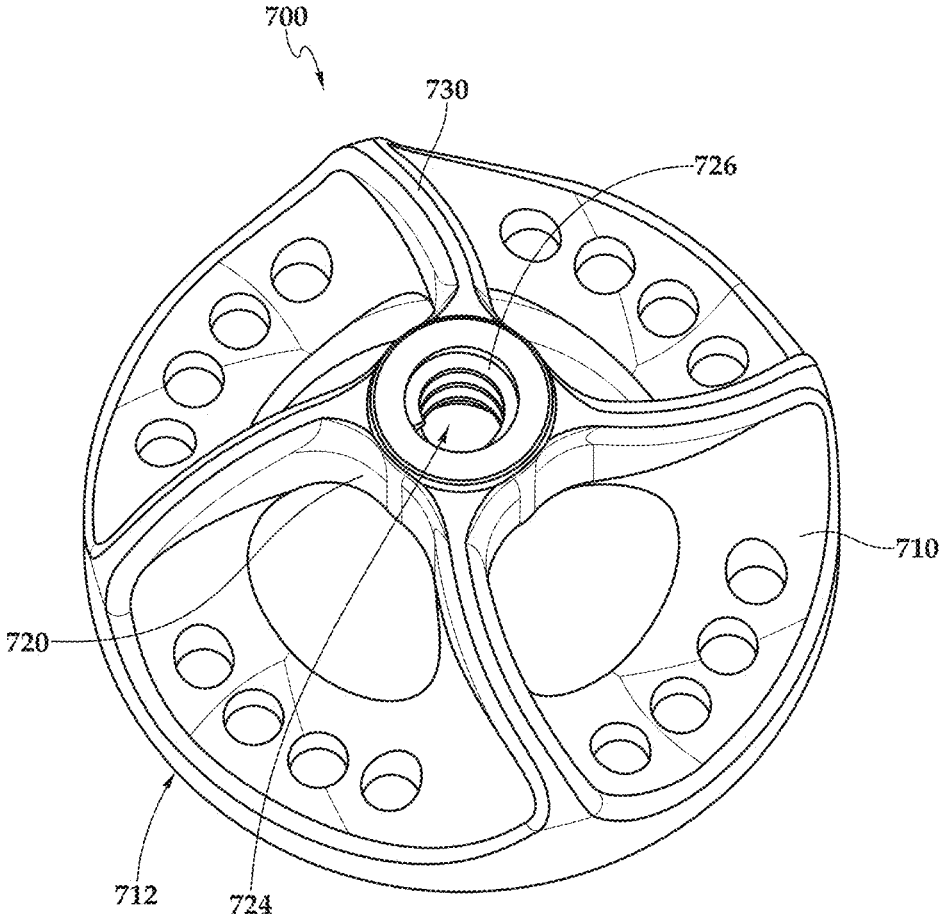
FIG. 28 shows a perspective view of a locking portion consistent with one embodiment of the present disclosure.

Referring now to FIG. 28, the locking portion 700 includes a body portion 710 and a lock portion 720. The body portion 710 includes a face 712 configured to contact a tile T or an angular spacer portion 500 or another spacing washer. The body portion also includes at least one grip portion 730 disposed opposite the face 712 to which force (e.g., rotating force) can be applied by a user. The lock portion 720 extends generally away from the face 712 and is configured to releasably mate with the stem portion 420/620 of an anchor 400/600.

Figure 27:
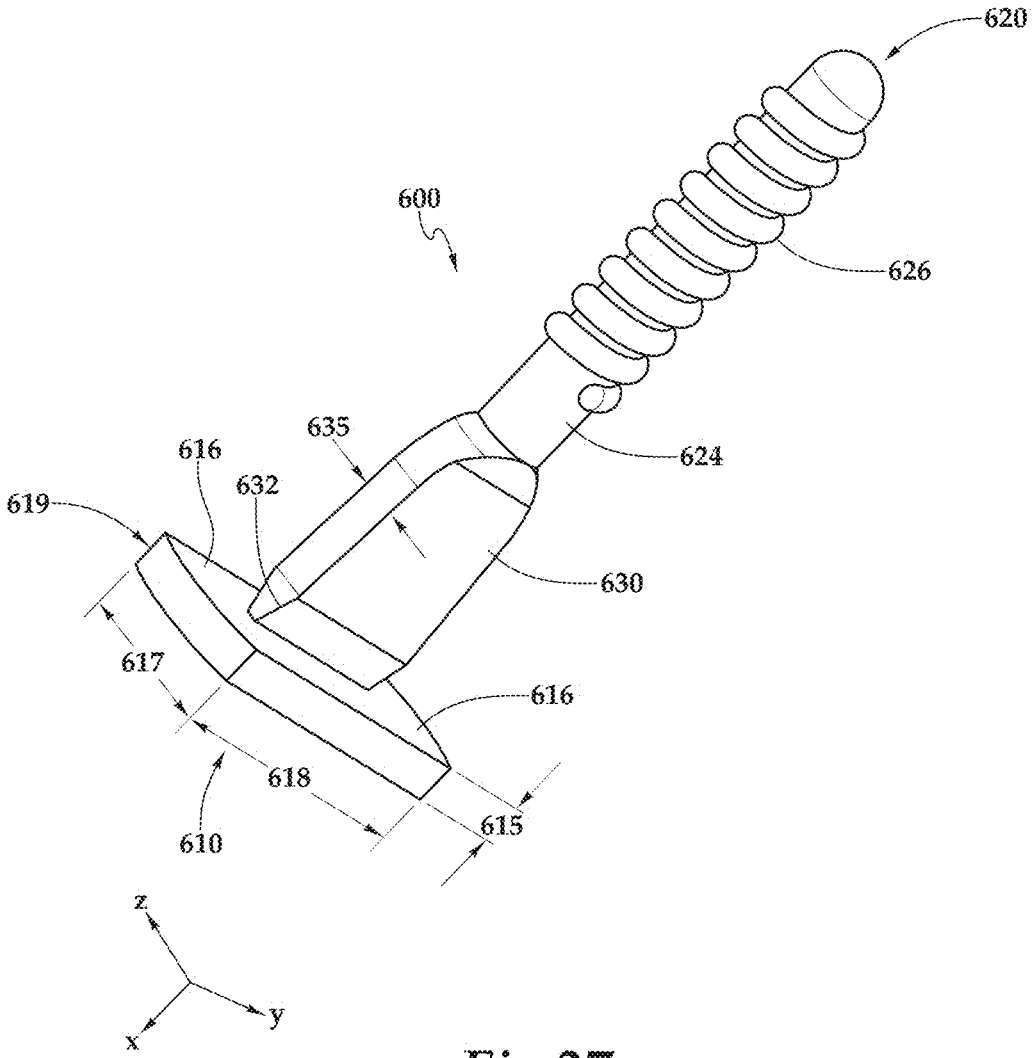
FIG. 27 shows a perspective view of a surface anchor portion consistent with one embodiment of the present disclosure.

Another example of a channel anchor 60 consistent with the present disclosure is shown FIGS. 1-7, and 19-20. In this example embodiment, the channel anchor 60 includes a channel anchor portion 600 and a locking portion 700. Referring now to FIG. 27, the channel anchor portion 600 is configured to mate (e.g., slidably mate) with a face channel 116/216 of a support rail 100/200. The channel anchor portion 600 includes a head portion 610 configured to mate with the surface channel 116/216 of a support rail 100/200. The head portion may include one or more lateral prongs 616 extending outwardly and each having a thickness 615 that is less than the corresponding inner dimension of the subchannels of the face channel 116/216. In the specific embodiment shown in FIG. 27, the lateral prongs 615 extend outwardly to form a generally flat profile having a substantially uniform thickness 615. In some embodiments, the head portion 610 has a width 617 that is less than the opening of the face channel 116/216 and that is less than the length 618 of the head portion 610. In such embodiments, the channel anchor portion 600 may be inserted at any desired point along the face channel 116/216 by inserting the head portion 610 into the face channel 116/216 such that the narrower width of 617 passes through the relatively wider opening of the face channel 116/216, and then twisting the channel anchor portion 600 by 90°. In some embodiments, the profile 619 of the narrower ends of the head portion 610 are curved, rounded, or not flat to facilitate such rotation.

The channel anchor portion 600 further includes a stem portion 620 disposed opposite the head portion 610 and configured to releasably mate with the locking portion 700. For example and without limitation, the stem portion 620 of the embodiment specifically shown in FIG. 27 includes threads 626 configured to complement threads 726 of an anchor lock 700.

The spacer portion 630 is disposed between the head portion 610 and the stem portion 620, and has a predetermined thickness 635 (e.g., maximum thickness) that defines the gap G between adjacent tiles T. In some embodiments, the thickness 635 that determines the gap G between adjacent tiles T is orthogonal to the axis along which the head portion 610 is configured to slide within the face channel 116/216.

The spacer portion 630 may include a relatively narrow head attachment portion 632 configured to break away from the head portion 610 when a force exceeding a minimum threshold force is applied to the stem portion 620 or to the spacer portion 630. For example and without limitation, the head attachment portion 632 may have a thickness (e.g., average thickness, median thickness, or maximum thickness) less than the thickness 635 of the spacer portion 630 that determines the gap G between adjacent tiles T. In such embodiments, the head attachment portion 632 enables convenient release of the spacer portion 630 from the head portion 610 to remove any portion of the anchor 600 that extends beyond the tile T, for example after the tile adhesive has cured. By removing all or substantially all of the spacer portion 630 from the gap G, grout or other fill can be conveniently applied between adjacent tiles T without unsightly spacers remaining visible or obstructing application of grout or fill between adjacent tiles T.

Figure 29:
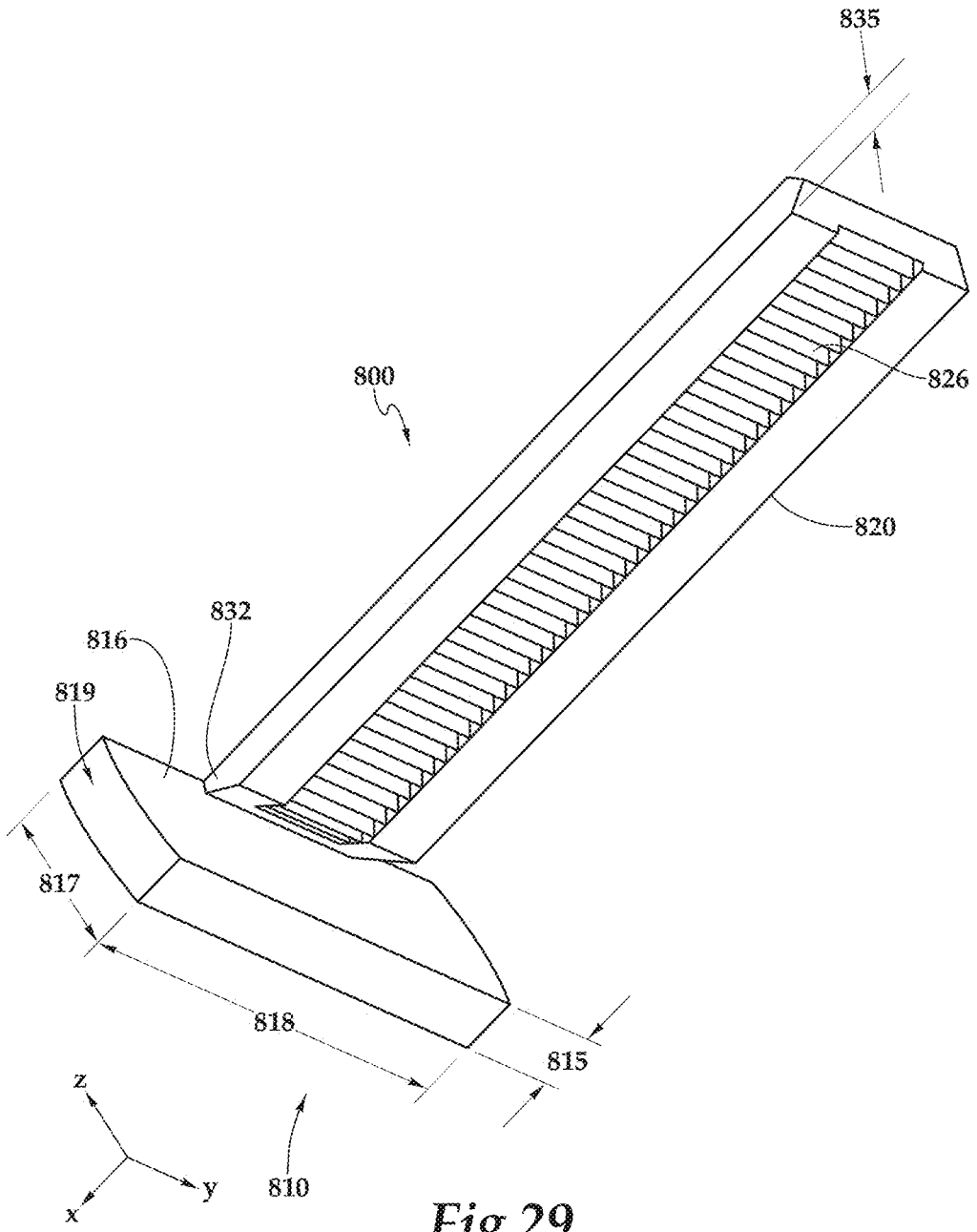
FIG. 29 shows a perspective view of a surface anchor portion consistent with one embodiment of the present disclosure.

Another example of a channel anchor 80 consistent with the present disclosure is shown FIGS. 1, 6-9, 15-16, and 18-21. In this example embodiment, the channel anchor 80 includes a channel anchor portion 800 and a locking portion 900. Referring now to FIG. 29, the channel anchor portion 800 is configured to mate (e.g., slidably mate) with a face channel 116/216 of a support rail 100/200. The channel anchor portion 800 includes a head portion 810 configured to mate with the surface channel 116/216 of a support rail 100/200. The head portion may include one or more lateral prongs 816 extending outwardly and each having a thickness 815 that is less than the corresponding inner dimension of the subchannels of the face channel 116/216. In the specific embodiment shown in FIG. 29, the lateral prongs 815 extend outwardly to form a generally flat profile having a substantially uniform thickness 815. In some embodiments, the head portion 810 has a width 817 that is less than the opening of the face channel 116/216 and that is less than the length 818 of the head portion 810. In such embodiments, the channel anchor portion 800 may be inserted at any desired point along the face channel 116/216 by inserting the head portion 810 into the face channel 116/216 such that the narrower width of 817 passes through the relatively wider opening of the face channel 116/216, and then twisting the channel anchor portion 800 by 90°. In some embodiments, the profile 819 of the narrower ends of the head portion 810 are curved, rounded, or not flat to facilitate such rotation.

The channel anchor portion 800 further includes a stem portion 820 disposed opposite the head portion 810 and configured to releasably mate with the locking portion 900. For example and without limitation, the stem portion 820 of the embodiment specifically shown in FIG. 29 includes a series of ratchets 826 disposed generally orthogonal to the direction in which the stem portion 820 extends from the head portion 810. The ratchets 826 are configured to complement one or more pawls 926 of an anchor lock 900.

The stem portion 820 has a predetermined thickness 835 (e.g., maximum thickness) that defines the gap G between adjacent tiles T or between a tile T and the floor F or the ceiling. In some embodiments, the thickness 835 that determines the gap G is orthogonal to the axis along which the head portion 810 is configured to slide within the face channel 116/216.

The stem portion 820 may include a relatively narrow head attachment portion 832 configured to break away from the head portion 810 when a force exceeding a minimum threshold force is applied to the stem portion 820. For example and without limitation, the head attachment portion 832 may have a thickness (e.g., average thickness, median thickness, or maximum thickness) less than the thickness 835 of the stem portion 820 that determines the gap G between adjacent tiles T. In such embodiments, the head attachment portion 832 enables convenient release of the stem portion 820 from the head portion 810 to remove any portion of the anchor 800 that extends beyond the tile T, for example after the tile adhesive has cured. By removing all or substantially all of the stem portion 820 from the gap G, grout or other fill can be conveniently applied between adjacent tiles T without unsightly spacers remaining visible or obstructing application of grout or fill between adjacent tiles T.

Figure 30:
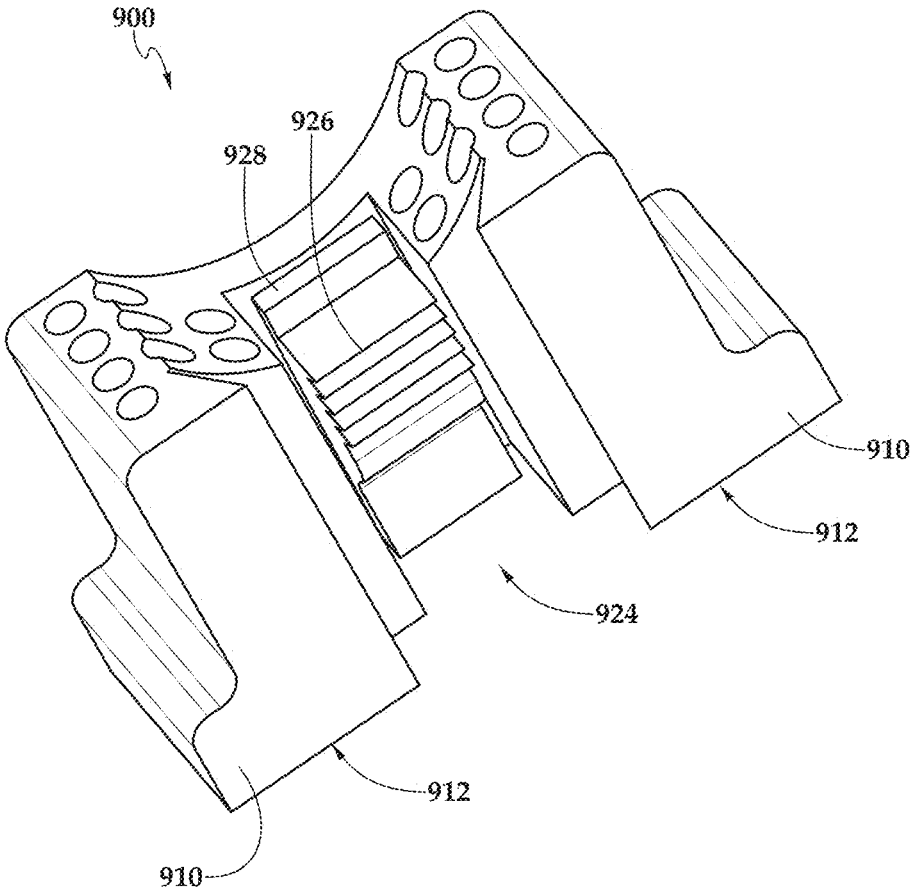
FIG. 30 shows a perspective view of a locking portion consistent with one embodiment of the present disclosure.

Referring now to FIG. 30, the locking portion 900 includes a body portion 910 including a face 912 and a passageway 924.

The face 912 is configured to contact a tile T, for example when the locking portion 900 is fully advanced along the stem portion 820 of the channel anchor portion 800.

Figure 21:
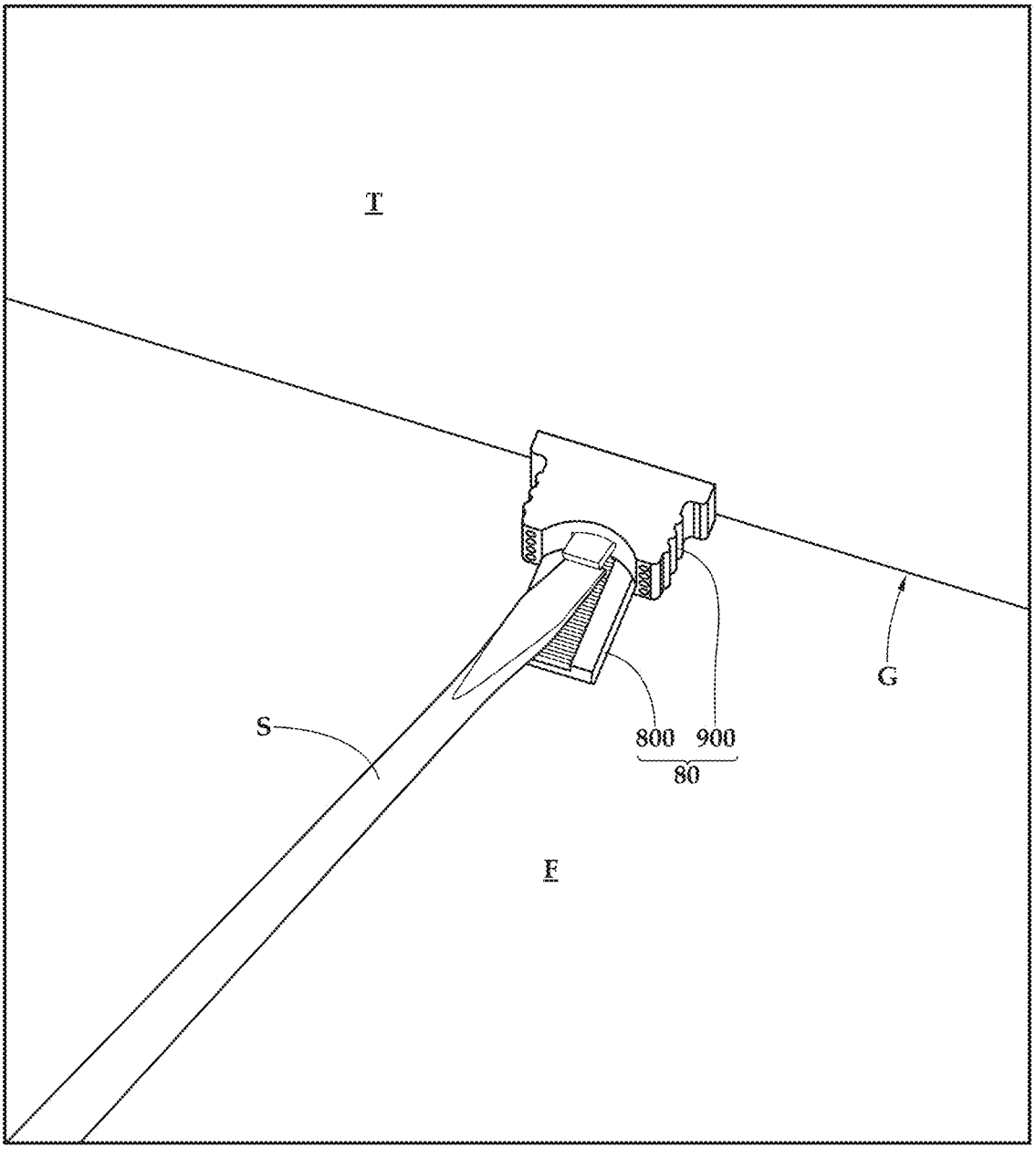
FIG. 21 shows a photograph of a surface channel anchor being released by a tool (S) so that the anchor portion can be removed after tile adhesive (not visible) has cured.

The passageway 924 is configured to receive (e.g., slidably receive) the stem portion 820 of the channel anchor portion 800. The passageway 924 may include one or more pawls 926 configured to enable the locking portion 900 to advance along the stem portion 820 (i.e., toward the head portion 810) but to resist (e.g., prevent) the locking portion 900 to retract along the stem portion 820 without a releasing force being applied by a user. For example, FIG. 21 shows a user lifting a release tab 928 away from the stem portion 820 of the channel anchor portion 800 to release the pawl(s) 924 from the ratchets 826 of the channel anchor portion 800. When the pawls 924 release from the ratchets 826, the locking portion 900 can be removed from the channel anchor portion 800.

The mounting anchors and their components may comprise, consist essentially of, or consist of any suitable material that provides suitable rigidity to resist deformation (e.g., substantially resist deformation) from forces imparted by the tile T, to resist deformation (e.g., substantially resist deformation) from compression forces imparted by the locking portion 700/900. Suitable materials should be reasonably resistant to degradation from the tile adhesive (e.g., mortar or construction adhesive), at least for the duration of the required curing process. For example and without limitation, the anchors 40/60/80 and their individual components 400/500/600/700/800/900 may comprise, consist essentially of, or consist of aluminum, steel, iron, zinc, resilient plastic, high hardness rubber, or a combination of any two or more of the foregoing.

Kits

Kits consistent with the present disclosure include at least one support rail 100/200, at least two support rail mounts 300, and at least two channel anchors 40/60/80.

EXAMPLES

Example 1. A system for installing tile, the system comprising:

- a first support rail (100) configured to support a first end of a tile;
- a second support rail (100) configured to support a second, opposite end of the tile;
- optionally a third support rail (200) configured to support a midportion of the tile;
- a corner mounting anchor (400) configured to separate the tile from a second tile or from an adjacent surface by a predetermined distance;
- a corner anchor lock (500+700) configured to mate (e.g., releasably mate) with the end mounting anchor and compress the tile towards the first, second, or optional third support rail;
- at least one edge mounting anchor (600 or 800) configured to separate the tile from a second tile or from an adjacent surface by a second predetermined distance; and
- an edge anchor lock (700 or 900) configured to compress the first or second end of the tile towards the first, second, or optional support rail.

Example 2. The system of Example 1, wherein the first support rail (100) comprises a corner channel (126) configured to receive the corner mounting anchor (600).

Example 3. The system of Example 1 or Example 2, wherein the first support rail (100) comprises a surface channel (116) configured to receive the edge mounting anchor (600 or 800).

Example 4. The system of any one preceding Example, wherein the first support rail (100) comprises an outer surface (110) comprising a plurality of grooves (112) configured to receive an adhesive.

Example 5. The system of any one preceding Example, wherein the first support rail (100) comprises an end surface (120) including a plurality of grooves (122) configured to receive an adhesive.

Example 6. The system of any one preceding Example, wherein the second support rail (100) comprises a corner channel (126) configured to receive the corner mounting anchor (600).

Example 7. The system of any one preceding Example, wherein the second support rail (100) comprises a surface channel (116) configured to receive the edge mounting anchor (600 or 800).

Example 8. The system of any one preceding Example, wherein the second support rail (100) comprises an outer surface (110) comprising a plurality of grooves (112) configured to receive an adhesive.

Example 9. The system of any one preceding Example, wherein the second support rail (100) comprises an end surface (120) including a plurality of grooves (122) configured to receive an adhesive.

Example 10. The system of any one preceding Example, wherein the optional third support rail (200) comprises a surface channel (216) configured to receive the edge mounting anchor (600 or 800).

Example 11. The system of any one preceding Example, wherein the corner mounting anchor (400) comprises:

a head portion (410) configured to mate with the corner channel (126) of the first or second support rail (100);

a stem portion (420) disposed opposite the head portion (410) and configured to releasably mate with the corner anchor lock (500+700); and a spacer portion (430) disposed between the head portion and the stem portion and having a predetermined thickness (435).

Example 12. The system of any one preceding Example, wherein the corner anchor lock (500+700) comprises a corner washer (500) and a lock (700).

Example 13. The system of Example 11 or Example 12, wherein the spacer portion (430) extends away from the head portion (410) and is configured to be removed from the head portion (410).

Example 14. The system of any one preceding Example, wherein the edge mounting anchor (600) comprises:

a head portion (610) configured to mate with the surface channel (116) of the first or second support rail (100) or with the surface channel (216) of the optional third support rail (200);

a stem portion (620) disposed opposite the head portion (610) and configured to releasably mate with the edge anchor lock (700 or 900); and a spacer portion (630) disposed between the head portion and the stem portion and having a predetermined thickness (635).

Example 15. The system of Example 14, wherein the spacer portion (630) extends away from the head portion (610) and is configured to be removed from the head portion (610).

Example 16. The system of any one preceding Example, wherein the edge anchor lock (700) comprises:

a body portion (710) including a face (712) configured to contact a tile, and at least one grip portion (730) disposed opposite the face (712); and a lock portion (720) extending away from the face (712) and configured to releasably mate with the corner mounting anchor (400) or the edge mounting anchor (600).

Example 17. The system of any one preceding Example, wherein the edge anchor lock (900) comprises:

a body portion (910) including a face (912) configured to contact a tile; and a lock portion (926) extending away from the face (912) and configured to releasably mate with the edge mounting anchor (800).

Example 18. The system of Example 17, wherein the edge mounting anchor (800) comprises:

a head portion (810) configured to mate with the surface channel (116) of the first or second support rail (100) or with the surface channel (216) of the optional third support rail (200); and a stem portion (820) disposed opposite the head portion (810) and configured to releasably mate with the edge anchor lock (900).

Example 19. The system of Example 18, wherein the stem portion (820) extends away from the head portion (810) and is configured to be removed from the head portion (810).

Example 20. The system of any one preceding Example further comprising at least one support rail mount (300) configured to secure the first support rail (100) to a surface (W1).

Example 21. The system of Example 20 further comprising an anchor configured to secure the first support rail (100) to the at least one support rail mount (300).

Example 22. The system of Example 20 or Example 21, wherein the support rail mount (300) comprises:

a base portion (310) comprising a mounting hole (314) configured to receive a wall anchor (302); and at least one leg portion (320) extending away from the base portion (310) and optionally including an anchor pilot hole (324) configured to receive a support rail anchor (322).

Example 23. The system of any one of Examples 20-22, wherein the first support rail (100) comprises at least one elongated opening (124) configured to enable the first support rail to be secured to the support rail mount (300) in an adjustable manner in a first dimension substantially perpendicular to the surface (W1).

Example 24. The system of Example 23, wherein the mounting hole (314) is elongated to enable the support rail mount (300) to be secured to the surface (W1) in an adjustable manner in a second dimension substantially perpendicular to the first dimension.

Example 25. A kit comprising:

at least two end support rails (100) each configured to support one end of a tile;

a plurality of support rail mounts (300) each configured to be secured to a surface and each configured to be adjustably secured to an end support rail;

a plurality of mounting anchors (400 or 500 or 700) each configured to temporarily secure an edge of a tile to an end support rail; and a plurality of mounting anchor locks (700 or 900) each configured to releasably mate with a mounting anchor and, when mated, to exert a compression force between an edge of the tile and an end support rail.

Example 26. The kit of Example 25 further comprising at least one support rail (200) configured to support a midportion of the tile.

Example 27. A method of installing tile on a surface, the method comprising:

securing a first support rail (100 or 200) to the surface (W1);

securing a second support rail (100 or 200) to the surface at a predetermined distance from and substantially parallel to the first support rail;

inserting an edge anchor (600 or 800) in a surface channel (116 or 216) of the first and/or second support rail;

adhering the tile to surfaces of the first and second support rail and in contact with the edge anchor;

temporarily applying a compression force between the tile and the first and/or second support rail by securing an edge anchor lock (700 or 900) to the edge anchor;

removing, after adherence of the tile is substantially complete, the edge anchor lock (700 or 900) from the edge anchor (600 or 800); and removing a distal portion (620+630 or 830) from the edge anchor (600 or 800).

Example 28. The method of Example 27, wherein the surface is a substantially vertical surface such as a wall.

Example 29. The method of Example 27 or Example 28, wherein the step of adhering the tile comprises disposing an adhesive between the tile and the first and/or second support rail.

What is claimed is:

1. A system for installing tile about a vertical corner defined by a first wall and an adjacent second wall offset from the first wall by an angle α, the system comprising:

a corner support rail disposed at a corner of a wall, the corner support rail comprising:

a first face, a second face offset from the first face by an angle, and a corner channel disposed between the first face and the second face;

a corner anchor system configured to simultaneously compress a first tile towards the first face and a second tile towards the second face, the corner anchor comprising:

a corner anchor including:

a head portion configured to slidably mate with the corner channel of the corner support rail, a stem portion disposed opposite the head portion, and a spacer portion disposed between the head portion and the stem portion and configured to:

separate an edge of the first tile from an edge of the second tile, and break away from the head portion in response to a force applied to the stem portion or the spacer portion; and a corner anchor lock configured to mate with the stem portion of the corner anchor and compress the first tile towards the first face and the second tile towards the second face.

2. The system of claim 1, wherein the angle β is 90°.

3. The system of claim 1, wherein the corner support rail further comprises a surface channel.

4. The system of claim 3 further comprising:

at least one edge mounting anchor comprising:

a second head portion configured to slidably mate with the surface channel of the corner support rail, a second stem portion disposed opposite the second head portion, and a second spacer portion disposed between the second head portion and the second stem portion and configured to break away from the second head portion; and an edge anchor lock configured to compress a third end of the first tile towards the corner support rail.

5. The system of claim 4, wherein the edge anchor lock comprises:

a body portion including a face configured to contact an outer face of the first tile, and at least one grip portion disposed opposite the face; and a lock portion extending away from the face and configured to releasably mate with the edge mounting anchor.

6. The system of claim 1, wherein the first face comprises an outer surface comprising a plurality of grooves configured to receive an adhesive.

7. The system of claim 1, wherein the second face comprises an end surface including a plurality of grooves configured to receive an adhesive.

8. The system of claim 1, wherein the corner anchor lock comprises a corner washer and a lock.

9. The system of claim 1 further comprising at least one support rail mount configured to secure the corner support rail to a surface.

10. The system of claim 9 further comprising an anchor configured to secure the corner support rail to the at least one support rail mount.

11. The system of claim 9, wherein the support rail mount comprises:

a base portion comprising a mounting hole configured to receive a wall anchor; and at least one leg portion extending away from the base portion.

12. The system of claim 9, wherein the corner support rail comprises at least one elongated opening configured to enable the corner support rail to be secured to the support rail mount in an adjustable manner in a first dimension substantially perpendicular to the surface.

13. The system of claim 1 further comprising a second support rail including a second surface channel.

14. The system of claim 13, wherein the second surface channel is configured to slidably receive the second head portion of the at least one edge mounting anchor.

15. The system of claim 13, wherein the second support rail further comprises a third face proximal to the second surface channel, the third face including a plurality of grooves configured to receive an adhesive.

16. The system of claim 13, wherein the second support rail does not include a corner channel.

17. A system for installing tile about a vertical corner defined by a first wall and an adjacent second wall offset from the first wall by an angle α, the system comprising:

a support rail disposed at the vertical corner, the support rail comprising:

a first face parallel to the first wall, a second face parallel to the second wall, and a corner channel disposed between the first face and the second face;

a corner mounting anchor comprising:

a head portion configured to slidably mate with the corner channel of the support rail, a stem portion disposed opposite the head portion, and a spacer portion disposed between the first head portion and the stem portion and configured to:

separate a first tile associated with the first face from a second tile associated with the second face, and break away from the head portion upon application of a force;

a corner anchor lock comprising a locking portion configured to releasably mate with the stem portion of the corner mounting anchor; and a corner spacer disposed between the corner anchor lock and the first and second tiles, the corner spacer comprising an angled face configured to simultaneously contact an outer surface of the first tile and an outer surface of the second tile.

18. The system of claim 17, wherein the angle α is not 0°.

19. A system for installing tile about a vertical corner defined by a first wall and an adjacent second wall offset from the first wall by an angle α, the system comprising:

a corner support rail disposed at the vertical corner, the corner support rail comprising:

a first face parallel to the first wall, a second face parallel to the second wall, and a corner channel disposed between the first face and the second face;

a corner anchor comprising:

a head portion configured to slidably mate with the corner channel of the corner support rail, a stem portion disposed opposite the head portion, and a spacer portion disposed between the first head portion and the stem portion and configured to:

separate a first tile associated with the first face from a second tile associated with the second face, and break away from the head portion upon application of a force;

a corner anchor lock comprising a locking portion configured to releasably mate with the stem portion of the corner anchor;

a corner spacer disposed between the corner anchor lock and the first and second tiles, the corner spacer comprising an angled face configured to simultaneously contact an outer surface of the first tile and an outer surface of the second tile;

an edge support rail disposed on the first or second wall a distance away from the corner support rail, the edge support rail comprising:

a third face parallel to the first or second wall, and a surface channel disposed on the third face;

an edge mounting anchor comprising:

a second head portion configured to slidably mate with the surface channel edge support rail, a second stem portion disposed opposite the second head portion, and a second spacer portion disposed between the second head portion and the second stem portion and configured to:

separate a third tile associated with the third face from a fourth tile associated with the third face, and break away from the second head portion upon application of a force; and an edge anchor lock configured to compress an end of the third tile towards the edge support rail, the edge anchor lock comprising:

a body portion including a face configured to contact an outer face of the third tile, and at least one grip portion disposed opposite the face, and a lock portion extending away from the face and configured to releasably mate with the edge mounting anchor.

20. The system of claim 19, wherein the angle $\alpha$ is not 0°.

* * * * *